US007704655B2

(12) United States Patent
Suzuki et al.

(10) Patent No.: US 7,704,655 B2
(45) Date of Patent: Apr. 27, 2010

(54) ELECTROPHOTOGRAPHIC PHOTORECEPTOR AND ELECTROPHOTOGRAPHIC APPARATUS

(75) Inventors: Hajime Suzuki, Kofu (JP); Tsuyoshi Ueda, Kofu (JP); Toshihiko Koizumi, Kofu (JP); Hideki Nakamura, Kofu (JP); Tetsuya Sakuma, Kofu (JP)

(73) Assignees: Yamanashi Electronics Co., Ltd., Kofu-Shi (JP); Ricoh Company, Ltd., Tokyo (JP)

( * ) Notice: Subject to any disclaimer, the term of this patent is extended or adjusted under 35 U.S.C. 154(b) by 0 days.

(21) Appl. No.: 12/182,303

(22) Filed: Jul. 30, 2008

(65) Prior Publication Data

US 2009/0004585 A1 Jan. 1, 2009

Related U.S. Application Data

(63) Continuation of application No. PCT/JP2007/051174, filed on Jan. 25, 2007.

(30) Foreign Application Priority Data

Jan. 31, 2006 (JP) ..... 2006-022435
Feb. 20, 2006 (JP) ..... 2006-042292

(51) Int. Cl.
*G03G 15/02* (2006.01)

(52) U.S. Cl. ..... 430/58.85; 430/59.5; 430/64; 399/159

(58) Field of Classification Search ..... 430/58.85, 430/59.5, 64; 399/159
See application file for complete search history.

(56) References Cited

FOREIGN PATENT DOCUMENTS

| | | | |
|---|---|---|---|
| JP | 1-106069 | | 4/1989 |
| JP | 9-304954 | | 11/1997 |
| JP | 11-119457 | | 4/1999 |
| JP | 2000-314977 | | 11/2000 |
| JP | 2001-125288 | A1 | 5/2001 |
| JP | 2003-280232 | A1 | 10/2003 |
| JP | 2004-252066 | A1 | 9/2004 |
| JP | 2004-354673 | A1 | 12/2004 |
| JP | 2005-274683 | A1 | 10/2005 |

OTHER PUBLICATIONS

International Search Report for International Application No. PCT/JP2007/051174 dated Feb. 13, 2007.

*Primary Examiner*—Mark A Chapman
(74) *Attorney, Agent, or Firm*—Kratz, Quintos & Hanson, LLP

(57) ABSTRACT

An electrophotographic photoreceptor which can respond to a reduction in diameter of photoreceptor and a process having high circumferential speed, due to the demand in the miniaturization and increase in the speed of copiers and printers. The photoreceptor has high sensitivity in long-wavelength region, and is free from deterioration of electric characteristics even after repeated use, and is highly stable. The electrophotographic photoreceptor has a conductive support member and a photosensitive layer laminated thereon, which includes at least a charge-generating agent, a charge-transfer agent, and a binder resin. The charge-generating agent is oxytitanium phthalocyanine, which has a Bragg angle (2θ±0.2°) providing a maximum peak at 27.2° in the X-ray diffraction spectra using CuKα as a radiation source.

4 Claims, 7 Drawing Sheets

ELECTROPHOTOGRAPHIC PHOTORECEPTOR AND ELECTROPHOTOGRAPHIC APPARATUS

The present invention is a Continuation of International Application No. PCT/JP2007/051174 filed Jan. 25, 2007, which claims priority to Japan Patent Document No. 2006-022435, filed on Jan. 31, 2006 and Japan Patent Document No. 2006-042292, filed on Feb. 20, 2006. The entire disclosures of the prior applications are hereby incorporated by reference herein in their entireties.

BACKGROUND

The present invention relates to an electrophotographic photoreceptor including oxytitanium phthalocyanine which is in specified crystal form, as a charge-generating agent, and including a specified compound as a charge-transfer agent.

As the exposure source for non-impact printer adopting electrophotographic method, long-wavelength light sources (such as semiconductor laser and LED) have mainly been applied in recent years. With the current movement of miniaturization and increased speeds for copiers and printers, a reduction in diameter of photoreceptor and a process having high circumferential speed have been adopted. As a result, a charge-generating agent having sensitivity in long-wavelength region is generally used for the electrophotographic photoreceptor. Conventionally, this type of material often adopts a phthalocyanine-based pigment. The phthalocyanine-based pigment is known to have different sensitivities depending on the crystal form thereof. In addition, along with the power-saving trend in recent years, the electrophotographic photoreceptor has been facing increasing requirement for higher sensitivity than ever to suppress the output of exposure source of electrophotographic apparatus such as a printer.

(1) As of phthalocyanine-based pigments, the one which has high sensitivity in a long-wavelength region includes oxytitanium phthalocyanine. Although there have been many crystal forms introduced for this oxytitanium phthalocyanine, the one having a maximum diffraction peak at 27.2° is accepted as highly-sensitive. If, however, oxytitanium phthalocyanine is used in a high-speed process, the potential characteristics of the photoreceptor become deteriorated after repeated use, and fog, black stripes, uneven concentration, or the like occurs in the formed image.

These phenomena presumably come from relatively large quantity of charge generated due to the high sensitivity characteristic of the oxytitanium phthalocyanine. That is, although the large quantity of generated charge normally has advantages such as high response, the charge remains in the photosensitive layer and remains in memory on the photoreceptor when the oxytitanium phthalocyanine is used in a high-speed process, thereby creating images as a memory phenomenon in the succeeding electrophotographic process. There is also an effect due to the charge transport capacity of a charge-transfer agent that is present; thus, the combination of both of them is important, for example, refer to JPA No. 1-106069

Consequently, it has been necessary to have an electrophotographic photoreceptor, which has high sensitivity in the long-wavelength region and which maintains the stability of electrophotographic characteristics even after repeated use at high speed, specifically the stability of reproducibility of an initial potential for a potential after repeated use. Even when a charge-generating agent having high charge-generating efficiency is used, if the compatibility with the charge-transfer agent is poor, satisfactory sensitivity cannot be attained and high quality image cannot be formed in various environments, when in use, ranging from high temperature and high humidity to low temperature and low humidity. Although compatibility between the charge-generating agent and the charge-transfer agent has been studied from various standpoints, it has not yet been definitely formed.

(2) On the other hand, various methods for manufacturing electrophotographic photoreceptor have been studied. A general method therefor is to disperse the charge-generating agent, the charge-transfer agent or the like in a solvent together with a binder resin to prepare the coating solution, and then apply the coating solution on a conductive support member to form a thin film.

In a general practice for forming the charge-transfer layer is to dissolve the charge-transfer agent and the binder resin in a coating-preparation solvent in order to form the coating solution, and then to apply the coating solution on a conductive support member, followed by drying the solution.

The charge-transfer agent, however, is difficult to be fully dissolved in varieties of solvents, and is also difficult to be fully dissolved in varieties of binder resins.

Conventionally, the use of methylene chloride or dichloroethane is examined as a coating-preparation solvent. These coating-preparation solvents are considered to have relatively high solubility to the above-discussed charge-transfer substances or binder resins, and to have a low boiling point in order to easily attain uniformity of coating film thickness and to make it easy to conduct drying (see, for example, JPA No. 2001-125288, JPA No. 2000-314977 and JPA No. 2004-354673).

However, when methylene chloride or dichloroethane is used as a coating-preparation solvent, there arises a problem of generation of portions decreasing locally the charged voltage in the organic photoreceptor, and of deterioration of the image quality by image noise, unless heating and drying are fully given after the application and formation of the charge-transfer layer to completely evaporate the coating-preparation solvent.

Moreover, in order to solve this problem, for a long period of heating and drying, there arises another problem of crack generation on the charge-transfer layer, thereby generating image noise, and a problem due to the difficulty in determining adequate drying condition, thereby making it difficult to increase the mass production yield.

(3) Recently additional electrophotographic apparatuses (such as, digital copier and printer) have been widely used, and the requirements for high image quality, miniaturization, and high speed have been further increasing.

Particularly for the high speed copier, which has short transition time from the exposure step to the development step, a problem occurs due to the failure in providing clear reproduction of dot image and fine lines. In response to this problem, there is proposed and commercially used a laminated electrophotographic photoreceptor which includes the photosensitive layer by allocating the functions, respectively, to the charge-generating layer that includes a charge-generating agent having high sensitivity in long-wavelength region and to the charge-transfer layer such that the charge-transfer agent having high plate life and high transfer degree is dispersed into the binder resin.

SUMMARY OF THE INVENTION

A subject of the present invention is to provide an electrophotographic photoreceptor which can respond to a reduction in diameter of photoreceptor and a process having high circumferential speed in order to achieve miniaturization and increase in the speed of copiers and printers, and high sensitivity in long-wavelength region, free from deterioration of electric characteristics even after repeated use, and has high stability.

Furthermore, an object of the present invention is to provide an electrophotographic photoreceptor which prevents image noise and crack generation thereon, thereby providing manufacturing thereof at high production yield.

Another object of the present invention is to provide an electrophotographic photoreceptor having high resolution, applied to digital electrophotographic apparatuses (such as, copiers and printers, for achieving high image quality, miniaturization, and high speed, and also to provide an electrophotographic apparatus using the electrophotographic photoreceptor.

The inventors of the present invention have conducted detailed studies to solve the above problems, and have found that the above problems of the related art can be solved by an electrophotographic photoreceptor which uses oxytitanium phthalocyanine showing a specified X-ray diffraction peak, as a charge-generating agent, and a specified compound as a charge-transfer agent, thereby having completed the present invention.

Furthermore, the detailed study of the inventors of the present invention have revealed that the photosensitive layer gives excellent characteristics when tetrahydrofuran is remaining in a coating-preparation solvent compared with other solvents except tetrahydrofuran remaining.

The present invention, which is achieved on the basis of the above findings, is an electrophotographic photoreceptor having a conductive support member and a photosensitive layer placed on the conductive support member, wherein the photosensitive layer includes a charge-generating agent and a charge-transfer agent, and wherein the charge-generating agent is oxytitanium phthalocyanine having a Bragg angle (2θ) giving a maximum peak at 27.2°±0.2° in the X-ray diffraction spectra using CuKα as a radiation source, and the charge-transfer agent includes at least one compound selected from the group consisting of compounds represented by the following chemical formulae (A1a) to (A1d), Formula (A1a)

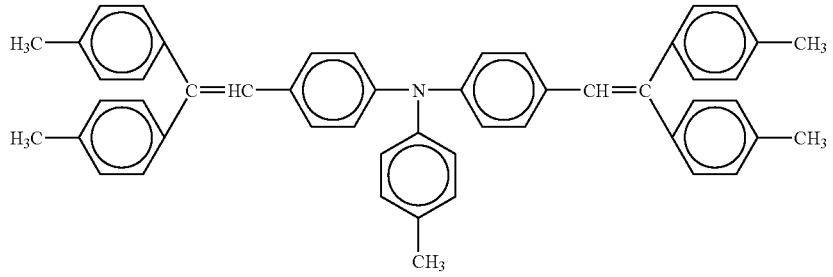

Formula (A1b)

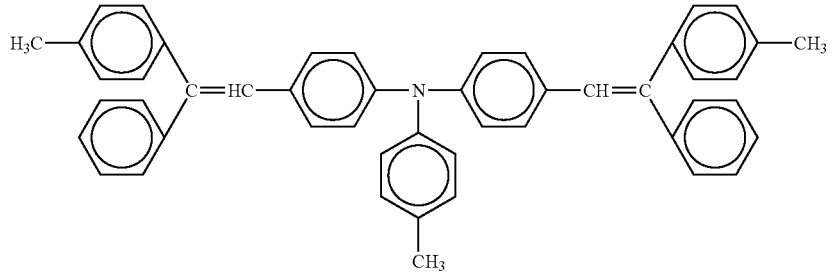

Formula (A1c)

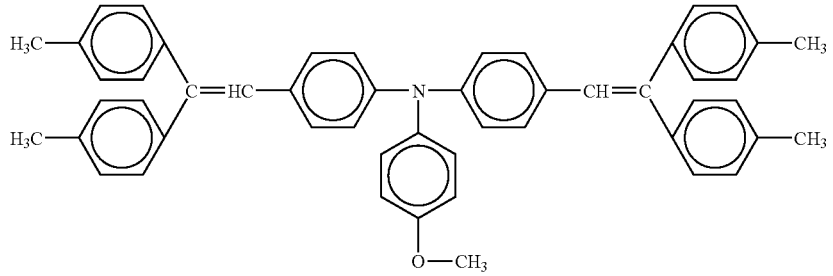

-continued

Formula (A1d)

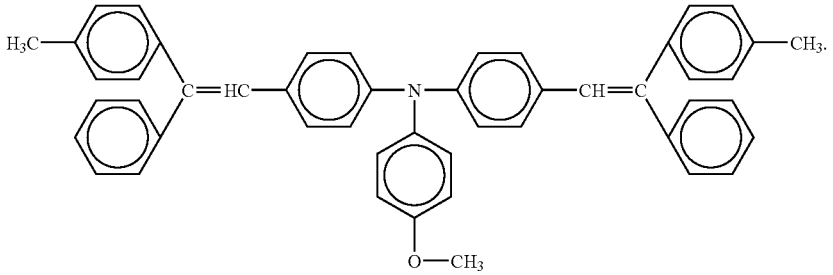

The present invention provides an electrophotographic photoreceptor, in which the photosensitive layer is formed by dissolving the charge-transfer agent in tetrahydrofuran, followed by evaporating the tetrahydrofuran, and the photosensitive layer contains the tetrahydrofuran.

The present invention provides an electrophotographic photoreceptor, in which the oxytitanium phthalocyanine has diffraction peaks at 9.7°, 14.2°, 18.0°, 24.2°, and 27.2° of Bragg angle (2θ±0.2°).

The present invention provides an electrophotographic photoreceptor, in which the photosensitive layer includes an aromatic amine-based antioxidant.

The present invention provides an electrophotographic apparatus having an electrophotographic photoreceptor, a charging device to charge the electrophotographic photoreceptor, an exposure device which exposes the charged electrophotographic photoreceptor to light in order to produce a latent image on the surface of the electrophotographic photoreceptor, and a development device which causes toner to adhere to the latent image on the surface of the electrophotographic photoreceptor. The apparatus transfers the toner adhered on the electrophotographic photoreceptor to a printing medium; and the electrophotographic photoreceptor includes a conductive support member and a photosensitive layer placed on the conductive support member, wherein the photosensitive layer includes a charge-generating agent and a charge-transfer agent. The charge-generating agent is oxytitanium phthalocyanine having a Bragg angle (2θ) giving a maximum peak at 27.2°+0.2° in the X-ray diffraction spectra using CuKα as a radiation source, and the charge-transfer agent includes at least one compound selected from the group consisting of compounds represented by the following formulae (A1a) to (A1d), Formula (A1a)

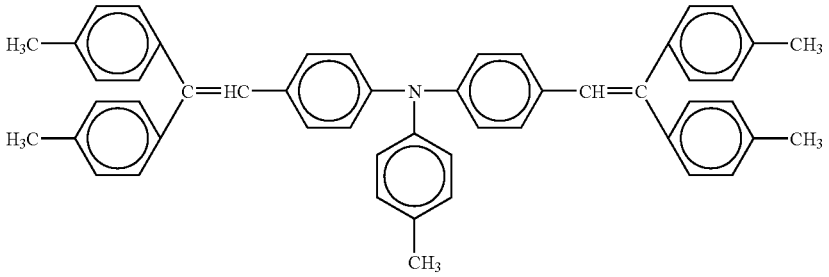

Formula (A1b)

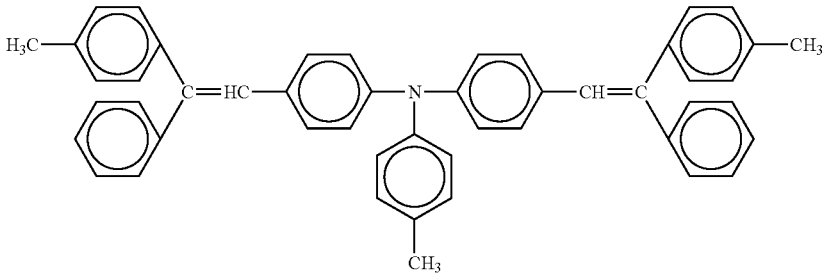

-continued

Formula (A1c)

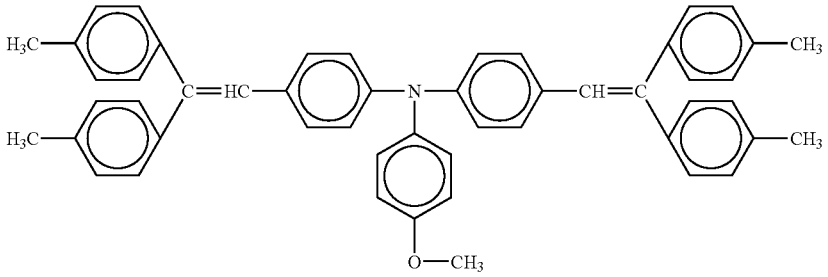

Formula (A1d)

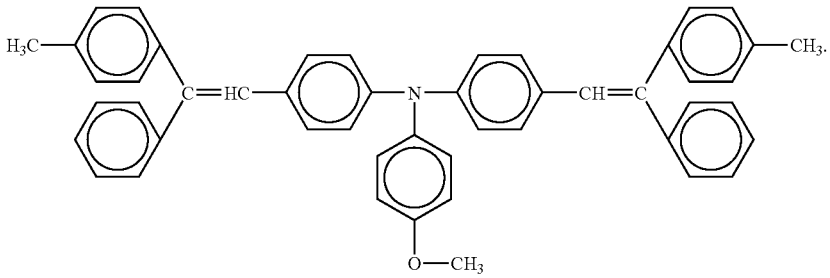

The present invention provides an electrophotographic apparatus which carries out the charging of the electrophotographic photoreceptor, the formation of the latent image, the adhesion of the toner, and the transfer of the toner, and then carries out the succeeding charging without neutralizing the electrophotographic photoreceptor.

The present invention provides an electrophotographic apparatus, in which the circumferential speed of the electrophotographic photoreceptor from the exposure position (where the electrophotographic photoreceptor is exposed to light) to the development position that causes the toner to adhere to the latent image is 0.1 second or less.

The present invention provides an electrophotographic apparatus in which the charging device is a contact charging device which is directly in contact with the electrophotographic photoreceptor.

The electrophotographic photoreceptor in combination of the charge-generating agent and the charge-transfer agent according to the present invention gives extremely low residual potential and exhibits excellent electrophotographic characteristics without generating residual image even used in an eraseless electrophotographic apparatus. As can be seen from the difference in characteristics between Examples and Comparative Examples as described below, the electrophotographic photoreceptor of the present invention has repeated-use stability and can meet the requirements of the severe market.

As a result, the present invention provides an electrophotographic photoreceptor which does not generate image noise caused by local decrease in the charged voltage and crack on the charge-transfer layer, gives excellent light resistance and charge property, and thus achieves stable and high production yield in a state of good image quality, and provides an electrophotographic apparatus using the electrophotographic photoreceptor.

DETAILED DESCRIPTION OF THE INVENTION

Figure 1:
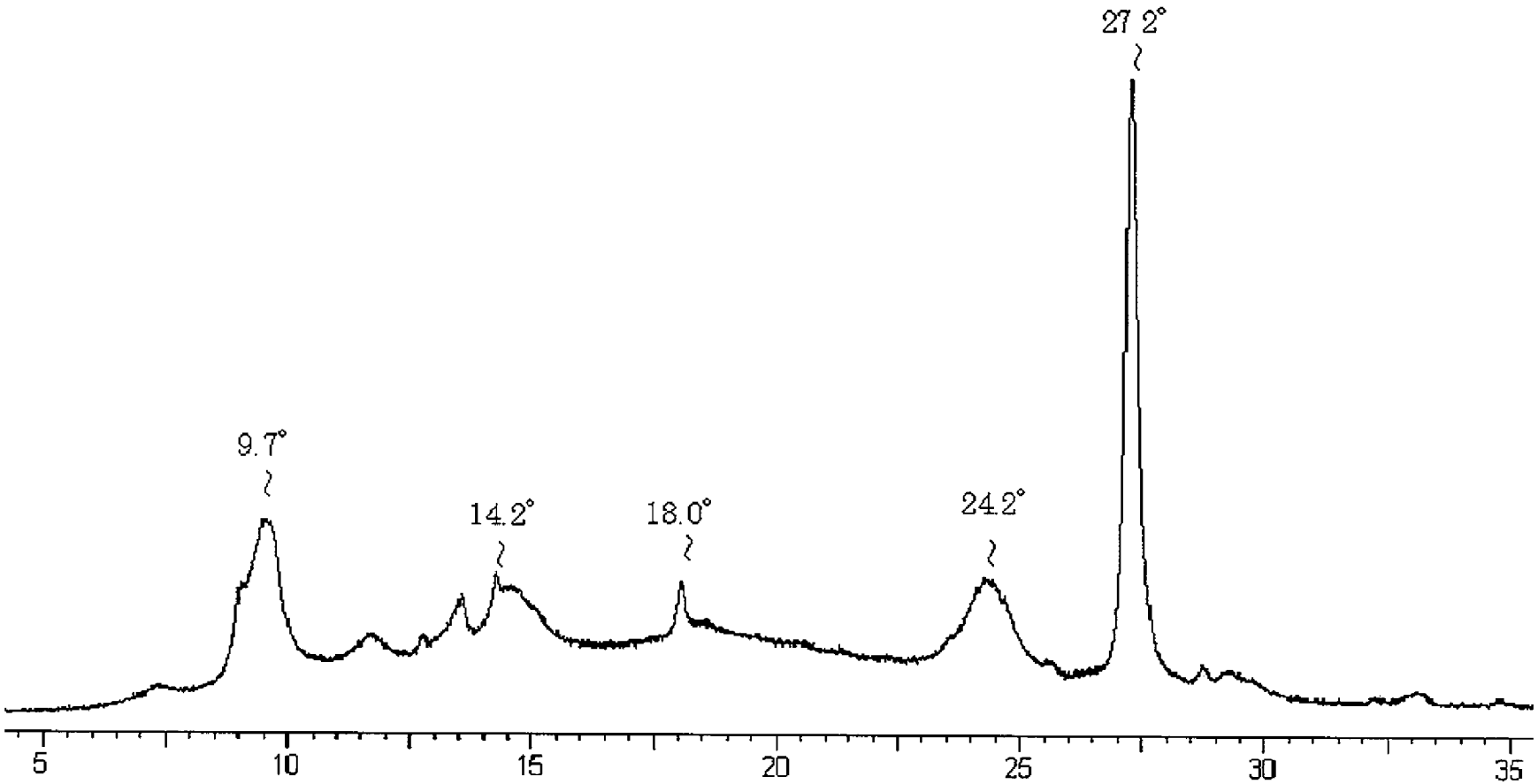
FIG. 1 is an X-ray diffraction chart of phthalocyanine composition according to the present invention.

The electrophotographic photoreceptor according to the present invention is composed by mixing an oxytitanium phthalocyanine having a specified X-ray diffraction spectrum as a charge-generating agent in a photosensitive layer on a support member.

A preferred embodiment of the electrophotographic photoreceptor according to the present invention is hereinafter described in detail. For example, the present invention applies a functional separation-type electrophotographic photoreceptor which is manufactured by forming the charge-generating layer, including at least charge-generating agent on the conductive support member, and then forming the charge-transfer layer including at least charge-transfer agent thereon. In this case, the photosensitive layer is formed by both the charge-generating layer and the charge-transfer layer.

As a method for forming the charge-generating layer, varieties of methods can be adopted. For example, the charge-generating layer can be formed by using the phthalocyanine composition according to the present invention as the charge-generating agent, by applying a coating solution dispersed or dissolved to an adequate solvent together with a binder resin, onto a specified support member which functions as a base material, and then, as appropriates drying the applied coating solution.

The charge-transfer layer has at least the charge-transfer agent as described later; and the charge-transfer layer can be formed by, for example, binding the charge-transfer agent onto the charge-generating layer as a base material with a binder resin.

There are varieties of methods for forming the charge-transfer layer. Normally applied methods include one in which the charge-transfer agent is dispersed or dissolved in an adequate solvent together with the binder resin in order to prepare the coating solution, and the coating solution is then applied on the charge-generating layer as a base material and is dried.

The method can also be applied to a reverse-laminated electrophotographic photoreceptor or the like, in which the charge-generating layer and the charge-transfer layer are laminated inversely. Furthermore, the method can be applied to a single-layer electrophotographic photoreceptor which includes the charge-generating agent and the charge-transfer agent in the same layer.

The single layer electrophotographic photoreceptor can be manufactured by applying the coating solution prepared by mixing and dispersing the oxytitanium phthalocyanine as a charge-generating agent, the charge-transfer agent described later, and the binder resin, onto the conductive support member as a base material, and followed by drying thereof.

The conductive support member applicable to the present invention includes a formed product of metal; such as, aluminum, brass, stainless steel, nickel, chromium, titanium, gold, silver, copper, tin, platinum, molybdenum, and indium, or metal alloy thereof. The shape of the conductive support member is arbitrary as long as the shape is one that is flexible such as a sheet, film, and belt, and may be endless or with ends.

The diameter of the conductive support member is specifically effective at 60 mm or less, and preferably 30 mm or less.

As of these, aluminum alloys of JIS 3000-series, JIS 5000-series, JIS 6000-series, or the like are applied, and preferable conductive support member includes one that is prepared by forming using ordinary method such as EI (Extrusion Ironing) method, ED (Extrusion Drawing) method, DI (Drawing Ironing) method, or II (Impact Ironing) method. Furthermore, the surface of the conductive support member may be treated by surface-cutting using diamond bite or the like, by surface treatment (such as, grinding and anodic oxidation treatment), or may be a non-cut tube without being subjected to machining and treatment.

The surface of the support member made of the above metal, alloy or the like may further be treated by vapor deposition, plating or the like to form a film of conductive substance thereon. The support member itself may be formed by a conductive substance. Alternatively, the film of the above metal, carbon or the like may be formed on the surface of the non-conductive plastics plate or film by a method of vapor deposition, plating or the like, thereby providing conductivity.

The kind and the shape of the conductive support member are not specifically limited, and the support member can be structured by using various materials having conductivity.

When resin is used as a support member, a conductive agent (such as, metal powder and conductive carbon) can be added to the resin, or a conductive resin can be used as a support member-forming resin.

In addition, when glass is used as the support member, the surface thereof may be covered with tin oxide, indium oxide, or aluminum iodide in order to provide conductivity.

Furthermore, a resin layer may be formed on the support member. The resin layer has the function of improving adhesion, the barrier function of preventing inflow current from an aluminum tube, the defect-covering function on the surface of the aluminum tube, or the like. As the resin layer, varieties of resins can be used (such as, polyethylene resin, acrylic resin, epoxy resin, polycarbonate resin, polyurethane resin, vinyl chloride resin, vinyl acetate resin, polyvinyl butyral resin, polyamide resin, nylon resin, alkyd resin, and melamine resin). Those resin layers may be formed by a single resin or may be formed by mixing two or more of them. The layer can disperse metal compound powder, carbon powder, silica powder, resin powder, or the like therein. Furthermore, in order to improve certain characteristics, the layer can include varieties of pigments, electron-accepting substance, electron-releasing substance, or the like.

As a charge-generating agent, there is applied oxytitanium phthalocyanine having a Bragg angle ($2\theta \pm 0.2°$) showing a maximum peak at 27.2° in the X-ray diffraction spectra using CuK$\alpha$ as a radiation source. Examples of the X-ray diffraction chart of the applied oxytitanium phthalocyanine are given in FIG. 1 and FIG. 2.

The above diffraction peak is observed under a condition such that the oxytitanium phthalocyanine is extracted from a photosensitive layer after forming the photosensitive layer. The use of this oxytitanium phthalocyanine allows providing an electrophotographic photoreceptor which has excellent sensitivity in long-wavelength region and exhibits stable characteristics independent of the environment in which it is used in a humid environment.

In the past, the X-ray diffraction spectra of oxytitanium phthalocyanine used for a electrophotographic photoreceptor are measured by using a powdered sample of oxytitanium phthalocyanine, which is crystallized in a specified crystal type after synthesis, or a pellet-shaped sample prepared from the coating solution containing the resin manufactured at the time of the formation of photosensitive layer, the dispersion solvent, or the like.

However, even when measurements of the X-ray diffraction spectra of oxytitanium phthalocyanine are conducted during the step before the formation of the photosensitive layer, the accurate determination of the crystal type of the oxytitanium phthalocyanine existing in the photosensitive layer cannot be conducted. That is, as the formation of photosensitive layer is affected by various external sources, the diffraction spectra may be different before and after the formation of photosensitive layer.

More specifically, for a laminated photoreceptor laminating the charge-transfer layer on the charge-generating layer, the coating solution including the charge-generating agent is applied on the support member, and is dried, if needed; then a coating solution including the charge-transfer agent is applied on the dried coating solution in order to form the charge-transfer layer, followed by drying the charge-transfer layer to fix the individual layers, thereby forming the photosensitive layer. Accordingly, the diffractive spectra of the charge-generating agent may change by crystal-transition caused by the thermal external sources through the drying process, and by the contact with solvent used in the coating solution for the formation of charge-transfer layer or the like; thus, there is a possibility of giving different crystal types between the diffraction spectra in a state of coating solution and in the final state of the photoreceptor. Consequently, in order to investigate the diffraction spectra of charge-generating agent in a state of actual use, the measurement is required at the time of extracting the charge-generating agent after forming the photosensitive layer.

When extracting the oxytitanium phthalocyanine from the photosensitive layer, care should be taken so as not to induce crystal-transition of the oxytitanium phthalocyanine. In addition, the photosensitive layer includes the binder resin, the charge-transfer agent, or the like, which hinders the measurement of X-ray diffraction spectra. Therefore, it is necessary to remove the binder resin, the charge-transfer agent, or the like, and to adequately select the solvent which does not modify the crystal type of oxytitanium phthalocyanine.

In order to attain adequate light-sensitive wavelength and sensitization effect, together with the oxytitanium phthalocyanine of the present invention, the photosensitive layer can include an oxytitanium phthalocyanine other than that of the present invention, an azo pigment or the like. The addition of those additives is preferable for obtaining good compatibility in terms of sensitivity. Other than the above-mentioned additives, there can be added monoazo pigment, bis-azo pigment, tris-azo pigment, poly-azo pigment, indigo pigment, threne pigment, toluidine pigment, pyrazoline pigment, perylene pigment, quinacridone pigment, pyrylium salt, or the like.

Examples of the binder resin for forming the photosensitive layer include polycarbonate resin, styrene resin, acrylic resin, styrene-acrylic resin, ethylene-vinyl acetate resin, polypropylene resin, vinyl chloride resin, chlorinated polyether, vinyl chloride-vinyl acetate resin, polyester resin, furan resin, nitryl resin, alkyd resin, polyacetal resin, polymethyl pentene resin, polyamide resin, polyurethane resin, epoxy resin, polyarylate resin, diarylate resin, polysulfone resin, polyether sulfone resin, polyaryl sulfone resin, silicone resin, ketone resin, polyvinyl butylal resin, polyether resin, phenol resin, EVA (ethylene-vinyl acetate) resin, ACS (acrylonitrile-chlorinated polyethylene-styrene) resin, ABS (acrylonitrile-butadiene-styrene) resin, and epoxy arylate resin.

They may be used solely, and can be used by mixing two or more of them. The mixed use of these resins having different molecular weights is preferable because of the improvement in hardness and the abrasion-resistance. When the photosensitive layer includes the charge-generating layer and the charge-transfer layer, the above-mentioned resins can be used for any of these layers.

The solvent used for the coating solution includes: alcohols (such as, methanol, ethanol, n-propanol, i-propanol, and butanol); saturated aliphatic hydrocarbons (such as, pentane, hexane, heptane, octane, cyclohexane, and cycloheptane); aromatic hydrocarbons (such as, toluene and xylene); chlorine-based hydrocarbons (such as, dichloromethane, dichloroethane, chloroform, and chlorobenzene); ethers (such as, dimethyl ether, diethyl ether, tetrahydrofuran (THF), and methoxyethanol); ketones (such as, acetone, methyl ethyl ketone, methyl isobutyl ketone, and cyclohexanone); esters (such as, ethyl formate, propyl formate, methyl acetate, ethyl acetate, propyl acetate, butyl acetate, and methyl propionate); ether-based solvent (such as, diethyl ether, dimethoxyethane, tetrahydrofuran, dioxolane, dioxane, or anisole); N,N-dimethyl formamide; and dimethyl sulfoxide. Preferred ones are ketone-based solvent, ester-based solvent, ether-based solvent, and halogenated hydrocarbon-based solvent, and as of these, tetrahydrofuran is preferred. These compounds can be used solely or as a mixture of two or more of them.

The electrophotographic photoreceptor according to the present invention includes a compound represented by the general formula (A1) as a charge-transfer agent. The compound represented by the general formula (A1) is the same compound as that represented by the general formula (C1).

General Formula (A1)

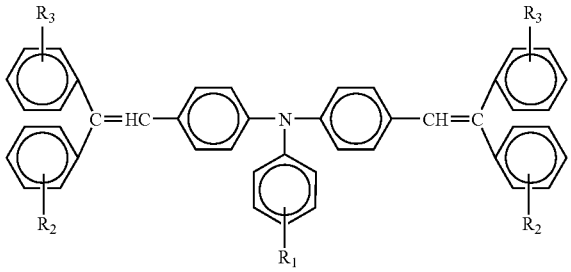

where, each of $R_1$ to $R_3$ represents a hydrogen, a halogen atom, a 1 to 6 of carbon number of alkyl group which may have a substituent, and a substituted or non-substituted aryl group having 6 to 12 of carbon number.

The above mentioned charge-transfer agent has good compatibility with the oxytitanium phthalocyanine of the present invention, and it is possible to provide an electrophotographic photoreceptor having a strong environmental resistance.

In the compounds represented by the general formula (A1), the compounds represented by the formulae (A1a) to (A1d) are preferable because they have good compatibility with the oxytitanium phthalocyanine of the present invention.

Examples of the compounds are given below. However, the applicable compounds are not limited to these examples. The compounds represented by the formulae (A1a) to (A1d) are the same as the compounds represented by the formulae (C1a) to (C1d), respectively, as later discussed.

Formula (A1a)

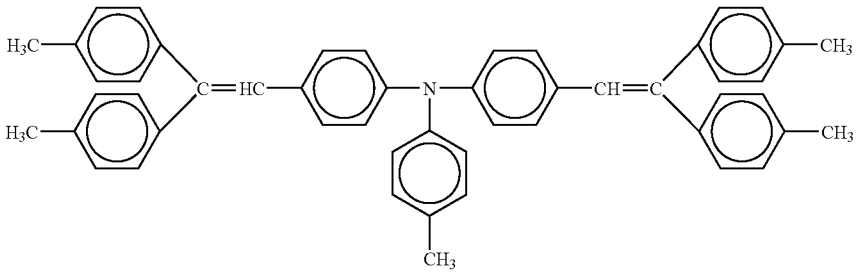

-continued

Formula (A1b)

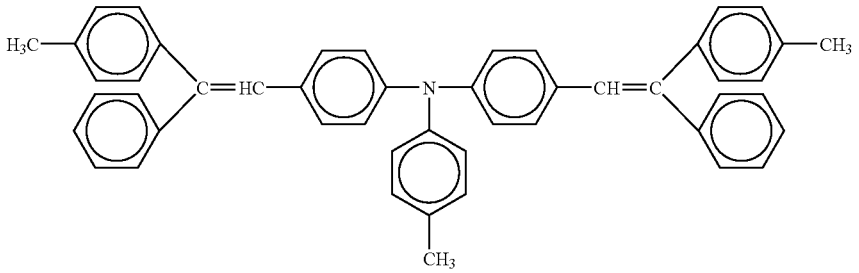

Formula (A1c)

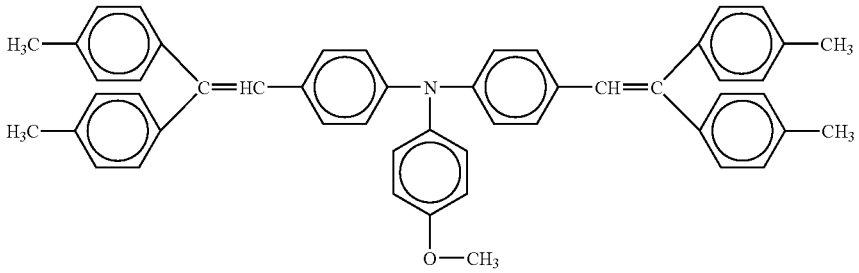

Formula A1d)

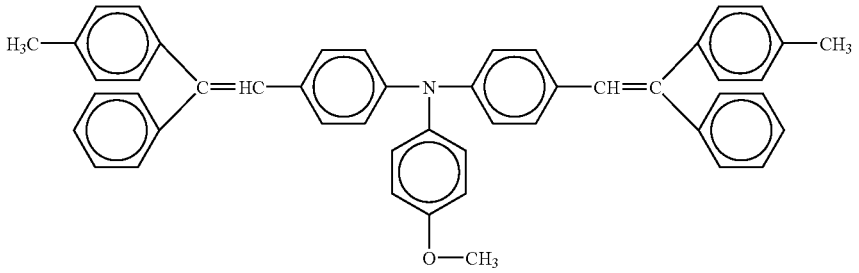

In this case, the content of the charge-transfer agent is preferably within the range of 0.3 to 2.0 parts by weight to 1 part by weight of the binder resin. If the content of this compound is less than 0.3 parts by weight, the electric characteristics become deteriorated including the increase in the residual potential. If the content of the compound exceeds 2.0 parts by weight, mechanical characteristics (such as, abrasion resistance) become deteriorated.

The compounds represented by the formulae (A1a) to (A1d) can be mixed with other charge-transfer agent for use. In such a case, the content ratio of the compounds of formulae (A1a) to (A1d) to other compound, [(A1a) to (A1d)] to (other compound), is preferably from 50:50 to 5:95, and more preferably from 30:70 to 5:95.

As to the other charge-transfer agents, the following conductive high polymer compounds can be used: polyvinyl carbazole, halogenated polyvinyl carbazole, polyvinyl pyrene, polyvinyl indroquinoxaline, polyvinyl benzothiophene, polyvinyl anthracene, polyvinyl acridine, polyvinyl pyrazoline, polyacetylene, polythiophene, polypyrrole, polyphenylene, polyphenylene vinylene, polyisothia naphthene, polyaniline, polydiacetylene, polyhepta diene, polypyridinediyl, polyquinoline, polyphenylene sulfide, polyferro cenilene, polyperi naphthylene, and polyphthalocyanine. In addition, the following low molecular weight compounds can be used: trinitrofluorenone, tetracyanoethylene, tetracyano quinodimethane, quinone, diphenoquinone, naphtoquinone, anthraquinone, and a derivative thereof; polycyclic aromatic compounds (such as, anthracene, pyrene, and phenanthrene); nitrogen-containing heterocyclic compounds (such as, indole, carbazole, and imidazole); fluorenone, fluorene, oxadiazole, oxazole, pyrazoline, hydrazone, triphenyl methane, triphenyl amine, enamine, and stilbene. Further, polymer molecule solid electrolytes prepared by doping a metal ion (such as, Li ion) to a polymer molecule compound (such as, polyethylene oxide, polypropylene oxide, polyacrylonitrile, or polymethacrylic acid) can be used. Furthermore, an organic charge-transfer complex composed of electron-releasing compound and electron-accepting compound, represented by tetrathiafulvalene-tetracyanoquinodimethane can be used. By adding only one of these compounds or adding two or more of these compounds by mixing, the desired characteristics of the photoreceptor can be obtained.

The coating solution for manufacturing the electrophotographic photoreceptor according to the present invention, (for example, coating solution for the charge-transfer layer, coating solution for the charge-generating layer, and coating solution for the monolayer-type photosensitive layer), can include antioxidant, UV absorber, free radical scavenger, softener, hardener, cross-linking agent, or the like to the extent that the characteristics do not become deteriorated in order to improve the characteristics, durability, and mechanical properties of the photoreceptor. More particularly, the antioxidant and the UV absorber are useful due to the contribution of the photoreceptor to the improvement in durability.

As for the photosensitive layer, aromatic amine-based antioxidant is preferably selected from the group of, for examples, N-phenyl-1-naphtylamine, N-phenyl-N'-isopropyl-p-phenylenediamine, N,N-diethyl-p-phenylenediamine, N-phenyl-N'-ethyl-2-methyl-p-phenylenediamine, N-ethyl- N-hydroxyethyl-p-phenylenediamine, alkylated diphenyl amine, N,N'-diphenyl-p-phenylenediamine, N,N'-diallyl-p-phenylenediamine, N-phenyl-1,3-dimethylbutyl-p-phenylene diamine, 4,4'-dioctyl-diphenyl amine, 6-ethoxy-2,2,4-trimethyl-1,2-dihydroquinoline, 2,2,4-trimethyl-1,2-dihydroquinoline, N-phenyl-β-naphthyl amine, and N,N'-di-2-naphthyl-p-phenylenediamine.

Preferred phenol-based antioxidants are preferably monophenol series such as 2,6-di-tert-butyl phenol, 2,6-di-tert-4-methoxyphenol, 2-tert-butyl-4-methoxyphenol, 2,4-dimethyl-6-tert-butyl phenol, 2,6-di-tert-butyl-4-methylphenol, butylated hydroxyanisole, β-(3,5-di-tert-butyl-4-hydroxy phenyl)stearyl propionate, α-tocopherol, β-tocopherol, and n-octadecyl-3-(3'-5'-di-tert-butyl-4'-hydroxyphenyl)propionate; and polyphenol series such as 2,2'-methylenebis(6-tert-butyl-4-methylphenol), 4,4'-butylidene-bis(3-methyl-6-tert-butylphenol), 4,4'-thiobis(6-tert-butyl-3-methylphenol), 1,1,3-tris(2-methyl-4-hydroxy-5-tert-butylphenyl)butane, 1,3,5-trimethyl-2,4,6-tris(3,5-di-tert-butyl-4-hydroxybenzyl)benzene, and tetrakis[methylene-3(3,5-di-tert-butyl-4-hydroxyphenyl)propionate]methane; and one or more thereof can be included at the same time in the photosensitive layer.

Preferred UV absorbers are selected from the group of benzotriazole group; such as, 2-(5-methyl-2-hydroxyphenyl) benzotriazole, 2-[2-hydroxy-3,5-bis(α,α-dimethylbenzyl) phenyl]-2H-benzotriazole, 2-(3,5-di-tert-butyl-2-hydroxyphenyl)benzotriazole, 2-(3-tert-butyl-5-methyl-2-hydroxyphenyl)-5-chlorobenzotriazole, 2-(3,5-di-tert-butyl-2-hydroxyphenyl)-5-chlorobenzotriazole, 2-(3,5-di-tert-amyl-2-hydroxyphenyl)benzotriazole, and 2-(2'-hydroxy-5'-tert-octylphenyl)benzotriazole; and salicylic acid series; such as, phenyl salicylate, p-tert-butylphenyl salicylate, and p-octylphenyl salicylate. One or more of the above antioxidants can be included at the same time in the photosensitive layer.

The additive amount of the phenol-based antioxidant to the electrophotographic photoreceptor of the present invention is preferably within the range of 3 to 20 parts per 100 parts of binder resin by weight. The additive amount of the UV absorber is preferably within the range of 3 to 30 parts per 100 parts of binder resin by weight.

Other than above, the addition of, e.g., dispersion stabilizer, antisettling agent, antiseparation agent, leveling agent, defoamer, thickening agent, matte agent, or the like would improve the finish appearance of the photoreceptor and the lifetime of the coating solution.

Furthermore, a surface-protection layer may be provided on the photosensitive layer by forming an organic thin film made of polyvinyl formal resin, polycarbonate resin, fluorine resin, polyurethane resin, silicone resin, or the like, or a film composed of siloxane structures formed by a hydrolyzed product of silane coupling agent. Formation of the surface-protection layer is preferred because of the improvement in the durability of the photoreceptor. The surface-protection layer may be formed in order to improve other functions except durability.

Figure 4:
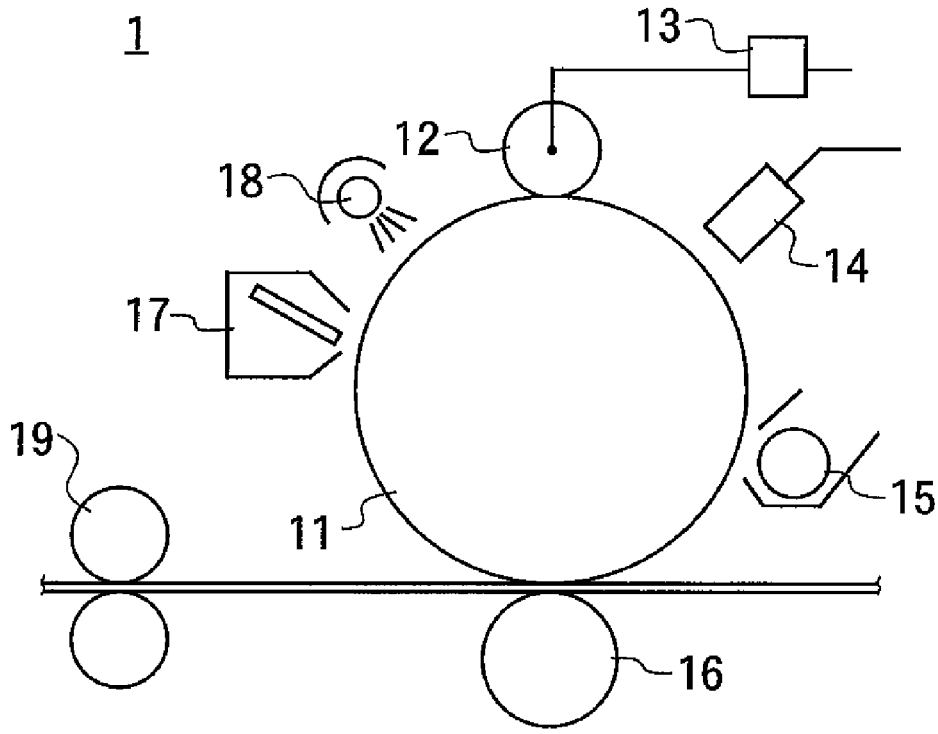
FIG. 4 illustrates a skeleton framework of the electrophotographic apparatus according to the present invention.
Figure 5:
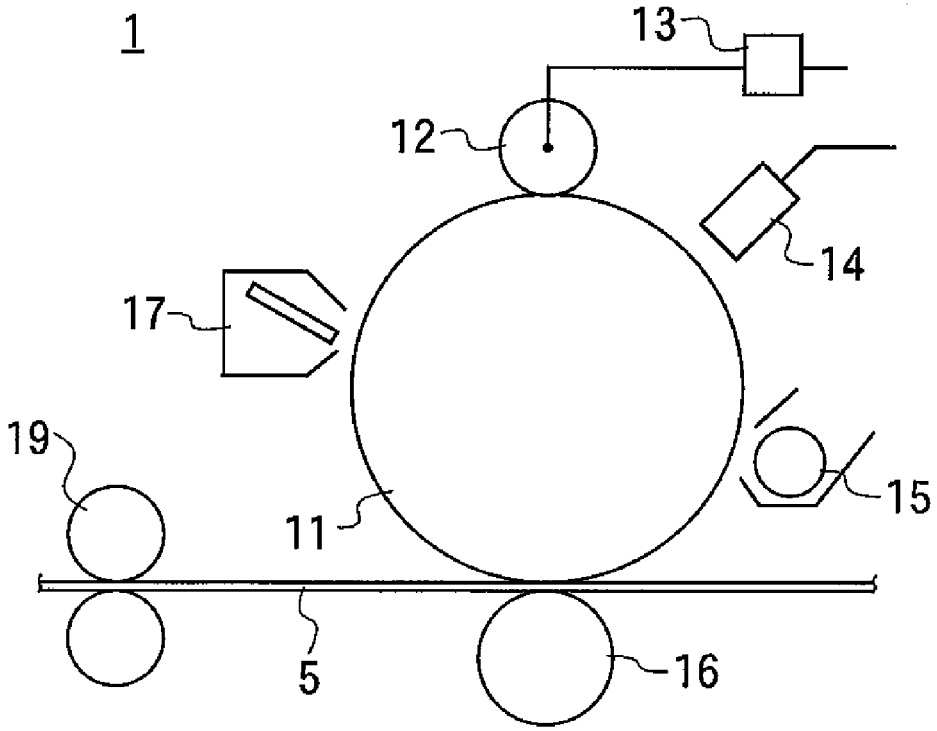
FIG. 5 illustrates a skeleton framework of the eraseless electrophotographic apparatus according to the present invention.

The electrophotographic apparatus according to the present invention is hereinafter described. FIG. 4 illustrates a skeleton framework of the electrophotographic apparatus according to the present invention. The reference number 11 indicates a photoreceptor. A charging member 12 is placed in contact with the photoreceptor 11. A voltage is applied to the charging member from a power source 13. Around the photoreceptor, an exposure device 14, a developing device 15, a transfer device 16, a cleaning device 17, and a neutralization device 18 are arranged. The reference number 19 indicates a fixing device. FIG. 5 illustrates the eraseless electrophotographic apparatus according to the present invention having the same structure to that of FIG. 4, except that the neutralization device 18 is not installed.

Next, other embodiments of the present invention are described below.

Although the solvent used for forming the photosensitive layer is not specifically limited as described above, tetrahydrofuran is specifically preferred.

The description of this invention adopts the compounds represented by the following general formula (C1) as a charge-transfer agent:

General formula (C1)

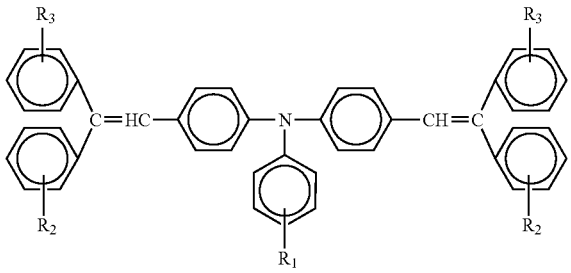

where, $R_1$ to $R_3$ each represent one or more substituent selected from a hydrogen, a halogen atom, an alkyl group having 1 to 6 of carbon number, and an aryl group having 6 to 12 of carbon number.

According to the present invention, alkyl group includes a substituted alkyl group in which alkyl group bonds to other substituents, and an unsubstituted alkyl group in which alkyl group does not bond to the other substituent, and aryl group includes a substituted alkyl group in which aryl group bonds to other substituents and an unsubstituted aryl group in which aryl group does not bond to other substituents.

In the compounds represented by the general formula (C1), the compounds given by the formulae (C1a) to (C1d) are specifically preferred due to good compatibility with tetrahydrofuran.

Examples of the compounds are given below. However, the applicable compounds are not limited to these examples.

Chemical formula (C1a)

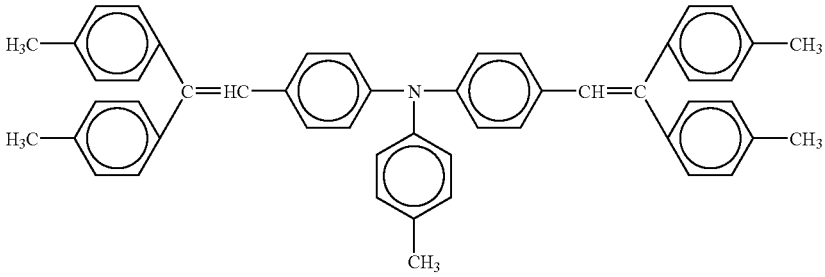

-continued

Chemical formula (C1b)

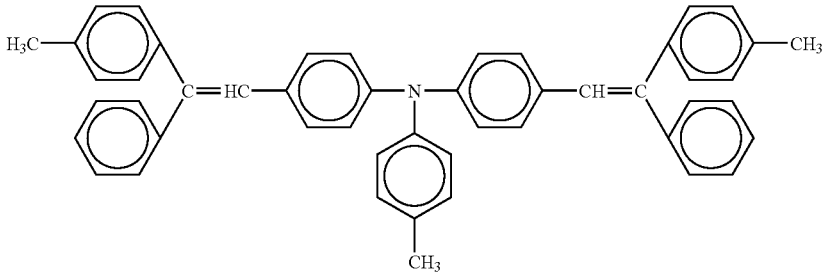

Chemical formula (C1c)

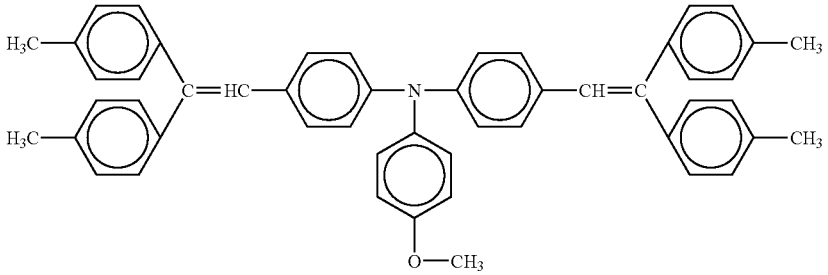

Chemical formula (C1d)

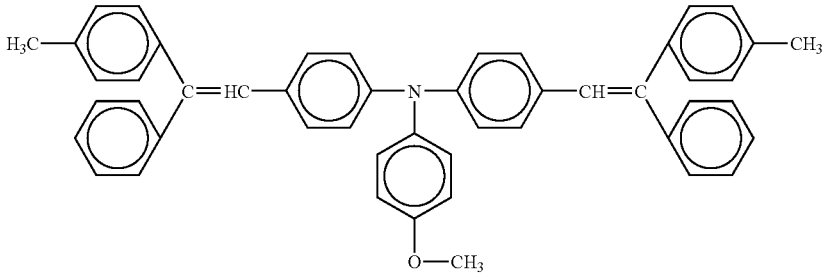

Figure 7:
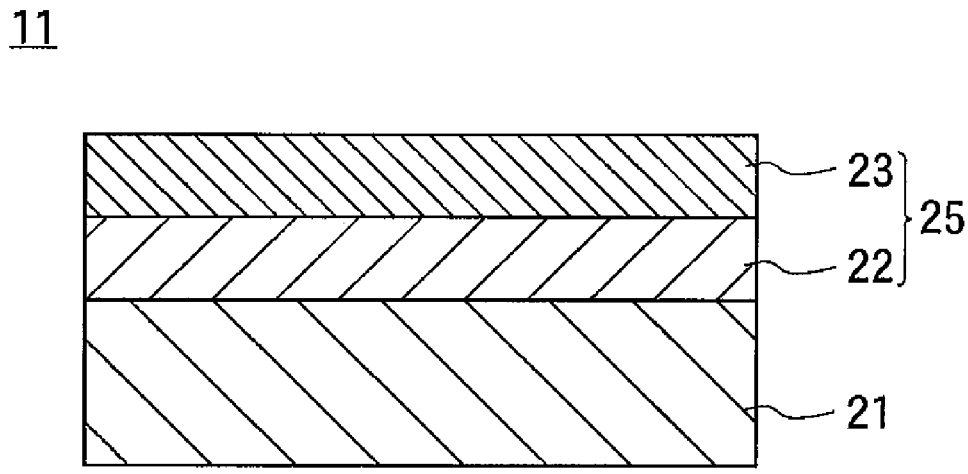
FIG. 7 shows a cross sectional view of an example of the electrophotographic photoreceptor according to the present invention.

The electrophotographic photoreceptor 11 of the present invention has a conductive support member 21 and a photosensitive layer 25 arranged on the conductive support member 21 (see FIG. 7). In this case, the electrophotographic photoreceptor 11 is a laminated electrophotographic photoreceptor, and the photosensitive layer 25 has, for example, a charge-generating layer 22 located on the conductive support member 21, and a charge-transfer layer 23 located on the charge-generating layer 22. The charge-transfer layer 23 includes at least the compound represented by any of the above formulae (A1a) to (A1d) and (C1a) to (C1d) as a charge-transfer agent.

Through the inclusion of the above charge-transfer agent in the charge-transfer layer 23, the photosensitive layer 25 has an advantage with respect to light resistance and charge performance.

The laminated electrophotographic photoreceptor 11 according to the present invention is hereinafter described in more detail.

The laminated electrophotographic photoreceptor 11 according to the present invention is a laminated organic photoreceptor in which the photosensitive layer 25 on the conductive support member 21 is structured by laminating at least the charge-transfer layer 23 on the charge-generating layer 22.

The process for forming the charge-generating layer 22 is described below. First, the above-described charge-generating substance and an adequate binder resin are dissolved or dispersed in a coating-preparation solvent to prepare a coating material, thereby obtaining a coating material for the charge-generating layer.

The resulting coating material for the charge-generating layer is applied on the conductive support member 21 by an ordinary coating method (such as, immersion coating, spin coating, spray coating, or electrostatic coating), and then dried to form the charge-generating layer 22 at a thickness of several micrometers, preferably within the range of 0.02 to 2 μm.

The coating material for the charge-transfer layer of the electrophotographic photoreceptor according to the present invention is obtained by dissolving the compound of any of the above formulae (A1a) to (A1d) and (C1a) to (C1d), which is an electron-releasing substance as a charge-transfer substance, and the binder resin in tetrahydrofuran as a coating-preparation solution.

Then, the coating material is applied on the charge-generating layer 22 using an ordinary coating method (such as, immersion coating, spin coating, spray coating, or electrostatic coating), thereby forming the charge-transfer layer 23.

Furthermore, the use of tetrahydrofuran as described later, as the coating-preparation solution for the charge-transfer layer 23, decreases the generation of image noise caused by the decrease in the local charged potential induced by the solvent remaining in the charge-transfer layer 23.

As a result, when the charge-transfer layer 23 is formed by applying and drying the coating solution including the charge-transfer agent dissolved in the coating-preparation solvent, no image noise is generated even if the tetrahydrofuran remains in the charge-transfer layer 23 by drying without heating at relatively low temperatures and in a relatively short time.

As described above, since the formation of the charge-transfer layer 23 does not need drying at high temperatures and for a long time, and since adequate drying condition can easily be adopted, the obtained charge-transfer layer 23 generates no crack; and thus, the high-sensitive photoreceptor having excellent light resistance and charge performance can be produced in a stable manner with a good image quality and at high yield.

When tetrahydrofuran is used as the solvent, the content of the charge-transfer agent in the charge-transfer layer 23 is preferably within the range of 0.5 to 0.8 parts by weight to 1 part by weight of the binder resin. If the content of this compound is less than 0.5 parts by weight, the electric characteristics become deteriorated, such as an increase in the residual potential. If the content thereof exceeds 0.8 parts by weight, the mechanical characteristics such as abrasion resistance decrease.

Furthermore, the mixture of the compound represented by any of the formulae (A1a) to (A1d) and (C1a) to (C1d) and other charge-transfer agents can be used in the same charge-transfer layer 23. When tetrahydrofuran is used as the solvent, the ratio of the content of the compound "a" of the formulae (A1a) to (A1d) and (C1a) to (C1d), to another charge-transfer agent "b", (a:b, weight ratio), is preferably 5:95 or more, and 50:50 or less, and more preferably in the range of 5:95 to 30:70.

The above description is for the laminated electrophotographic photoreceptor 11 structured by laminating in a sequential order of the charge-generating layer 22 and the charge-transfer layer 23 on the conductive support member 21. The present invention, however, is not limited to such structure, and can also include a laminated electrophotographic photoreceptor 11 where the lamination order of the charge-generating layer 22 and the charge-transfer layer 23 is reversed so as to laminate in a sequential order of the charge-transfer layer 23 and the charge-generating layer 22 on the conductive support member 21.

Figure 8:
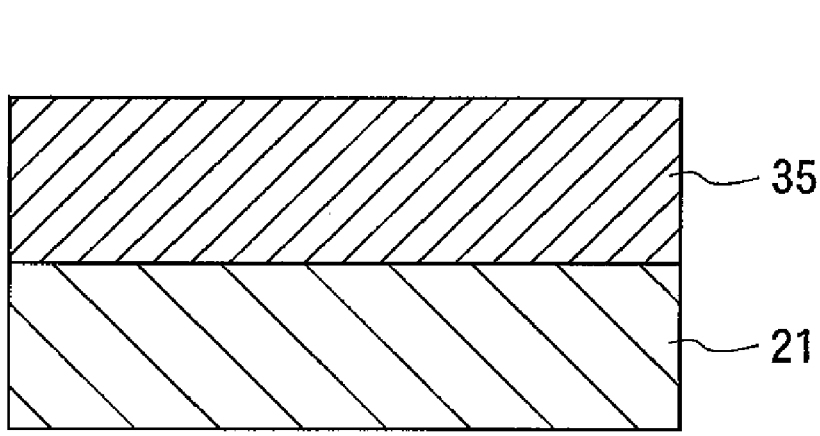
FIG. 8 shows a cross sectional view of another example of the electrophotographic photoreceptor according to the present invention.

Furthermore, the present invention can be applied to a single layer electrophotographic photoreceptor 31 in which both the charge-generating agent and the charge-transfer agent exist in the same layer 35 (see FIG. 8).

As described above, generally for the electrophotographic apparatus on which the electrophotographic photoreceptor is mounted, the charging method may be either the contact type (such as, brush type or roller type), or the non-contact type (such as, scorotron type or corotron type), and the charge may be either positive or negative.

The exposure type may be LED, LD, or the like. The development type may be two-component, single-component, or magnetic/non-magnetic type. The transfer type may be roller type, belt type, or the like.

The electrophotographic apparatus in FIG. 5 is described in more detail in the following. The electrophotographic apparatus 1 has the above-described electrophotographic photoreceptor 11.

The electrophotographic photoreceptor 11 is formed by the cylindrical conductive support member 21 and the above-described photosensitive layer 25 formed on the surface of the conductive support member 21, resulting in a completely cylindrical shape. The electrophotographic photoreceptor 11 is structured to rotate around the central axis driven by a rotary member (not shown).

Around the electrophotographic photoreceptor 11, the charging device 12, the exposure device 14, the development device 15, the transfer device 16, and the cleaning device 17 are arranged in this order in the rotational direction of the electrophotographic photoreceptor 11.

When the electrophotographic photoreceptor 11 is rotated at a constant circumferential speed, the surface of the photosensitive layer 25 is uniformly charged to a desired potential by the charging device 12, then the charged portion is exposed to light by the exposure device 14 in order to erase the charge on the exposed portion, thereby forming an electrostatic latent image on the photosensitive layer 25, and the development device 15 visualizes to develop the electrostatic latent image on the unexposed portion, and then the transfer device 16 transfers the thus obtained toner image onto a recording paper 5.

The recording paper 5 on which the toner image is transferred is sent from the electrophotographic photoreceptor 11 to the fixing device 19. The fixing device 19 then applies heat and pressure to the toner on the recording paper 5 to fix the toner to the recording paper 5.

The photosensitive layer 25 after the toner image is transferred to the recording paper 5 is fed to the cleaning device 17 by the rotation of the electrophotographic photoreceptor 11. After cleaning, the photosensitive layer 25 is again fed to the charging device 12, consequently repeating the above-described steps of charge, exposure, development, and transfer.

In the electrophotographic apparatus according to the present invention, the image is formed under the condition of 0.1 second or less of the circumferential speed of the photoreceptor within a distance from the exposure point to the development point of the electrophotographic photoreceptor 11.

The circumferential speed of the photoreceptor within the distance from the exposure point to the development point (that is, the circumferential speed of the photoreceptor from the image exposure step to the development step) is the time between the position where the irradiation for image exposure is completed and the position where the adhesion of toner begins by the development.

Figure 9:
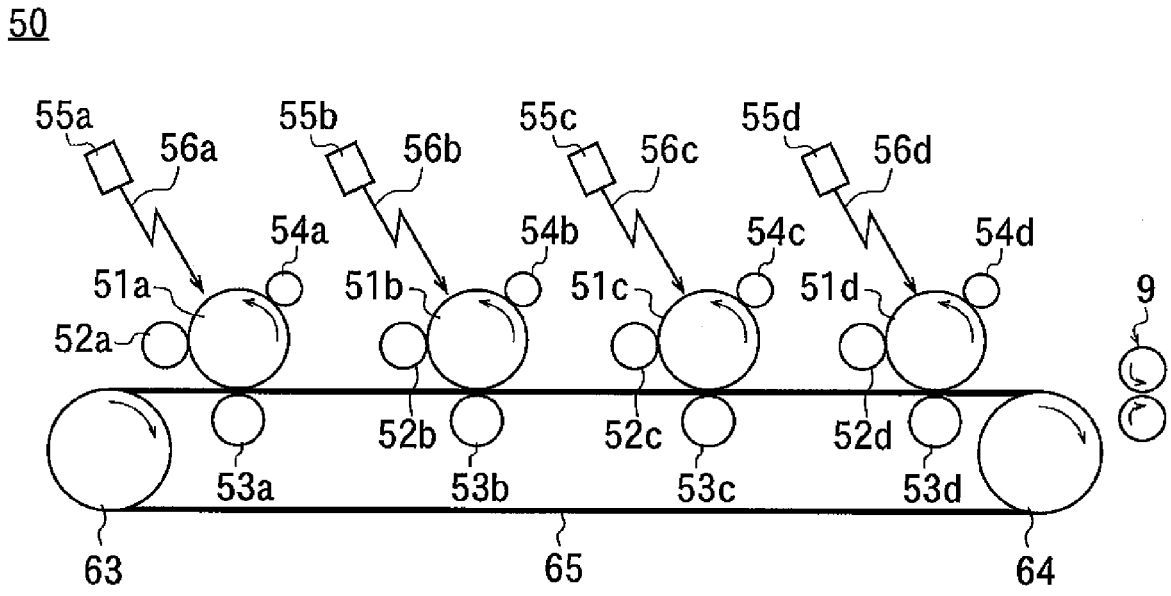
FIG. 9 illustrates a skeleton framework of the electrophotographic apparatus for color printing according to the present invention.

The electrophotographic photoreceptor according to the present invention can also be used for an electrophotographic apparatus for color printing. The reference number 50 in FIG. 9 indicates the electrophotographic apparatus for color printing.

The electrophotographic apparatus 50 has a plurality of electrophotographic photoreceptors 51*a* to 51*d*. Each of the electrophotographic photoreceptors 51*a* to 51*d* is structured by the electrophotographic photoreceptor given by the reference number 11 in FIG. 7 or by the electrophotographic photoreceptor given by the reference number 31 in FIG. 8. The photosensitive layers 25 and 35 of the electrophotographic photoreceptors 51*a* to 51*d* include oxytitanium phthalocyanine having a maximum peak at the Bragg angle ($2\theta \pm 0.2°$) of 27.2, and include any one of the charge-transfer agents of the above formulae (A1a) to (A1d) and (C1a) to (C1d).

Near to each of the electrophotographic photoreceptors 51*a* to 51*d*, charging devices 54*a* to 54*d*, exposure devices 55*a* to 55*d*, and developing apparatuses 52*a* to 52*d* are respectively arranged.

To each of the development devices 52*a* to 52*d*, different color toners are allocated. In this embodiment, four units of electrophotographic photoreceptors 51*a* to 51*d* are installed, and for each of the development devices 52*a* to 52*d* near the respective electrophotographic photoreceptors 51*a* to 51*d*, each of the four colored toner, red, blue, yellow, and black, is allocated.

Each of the electrophotographic photoreceptors 51*a* to 51*d* has a cylindrical support member and a photosensitive layer formed on the outer circumferential surface of the support member.

In the vicinity of each of the electrophotographic photoreceptors 51*a* to 51*d*, there is mounted a ring-shaped transfer belt 65 turning around two feed rollers 63 and 64.

Inside the ring of the transfer belt 65, a plurality of press rollers 53*a* to 53*d* are arranged. Each of the electrophotographic photoreceptors 51*a* to 51*d* is positioned outside the ring of the transfer belt 65. By the press rollers 53*a* to 53*d*, the electrophotographic photoreceptors 51*a* to 51*d* are brought into close contact with the outer circumferential surface of the transfer belt 65.

When the feed rollers 63 and 64 rotate in the same direction, the portions of the transfer belt 65 being in contact with the feed rollers 63 and 64 is rotated to move in the direction not sliding on the feed rollers 63 and 64; and thus, the entire transfer belt 65 circulates.

Each of the electrophotographic photoreceptors 51*a* to 51*d* is structured to rotate in the inverse direction from the rotational direction of the feed rollers 63 and 64; that is, in the direction not sliding on the transfer belt 65 when the transfer belt 65 moves. Thus, when the feed rollers 63 and 64 and the electrophotographic photoreceptors 51*a* to 51*d* are rotated in order to rotate the transfer belt 65 in the specified direction, the electrophotographic photoreceptors 51*a* to 51*d* pass the position facing the charging devices 54*a* to 54*d*, the exposure devices 55*a* to 55*d*, and the development devices 52*a* to 52*d*, and then the electrophotographic photoreceptors 51*a* to 51*a* are in contact with the transfer belt 65.

Both the charging devices 54*a* to 54*d* and the exposure devices 55*a* to 55*d* are connected to the power source device and the control device, respectively. The charging devices 54*a* to 54*d* apply voltage to the electrophotographic photoreceptors 51*a* to 51*d*, thereby charging the surface of the rotating electrophotographic photoreceptors 51*a* to 51*d* and the exposure devices 55*a* to 55*d* irradiate laser lights 56*a* to 56*d* to the electrophotographic photoreceptors 55*a* to 55*d*, respectively, responding to the data entered from the control device, thereby forming the latent image corresponding to the content of the data on the surface of each of the electrophotographic photoreceptors 51*a* to 51*d*.

Once each of the electrophotographic photoreceptors 51*a* to 51*d* rotates to a position facing each of the development devices 52*a* to 52*d*, toner having each color adheres to each of the electrophotographic photoreceptors 51*a* to 51*d*; and further, when the electrophotographic photoreceptors 51*a* to 51*d* rotate so as to be in contact with the transfer belt 65, the adhered toner is transferred onto the transfer belt 65.

According to the structure of the apparatus, toner of each color is transferred to each different position on the transfer belt 65. The transfer belt 65 is in contact with a printing medium (such as, paper at the downstream side of the moving transfer belt 65), thereby transferring the toner on the transfer belt 65 to the printing medium. The printing medium is in contact with the transfer belt 65 at portions where different colors adhere by the same number of contact to the number of colors. At each contact, a toner of different colors is transferred to the printing medium.

When the electrophotographic photoreceptors 51*a* to 51*d* move so as to face against the charging devices 54*a* to 54*d*, the exposure devices 55*a* to 55*d*, and the development devices 52*a* to 52*d*, in this sequential order, the electrophotographic photoreceptors 51*a* to 51*d* corresponding to red, blue, yellow, and black toners are arranged in this order from the upstream side of the transfer belt 65 that moves together with the electrophotographic photoreceptors 51*a* to 51*d*. Thus, the toner is overlaid on the printing medium in the order of black, yellow, blue, and red.

The printing medium that completes the transfer of the toners of respective colors is separated from the transfer belt 65, and passes through the fixing device 19 to fix the toner; and then, the printing medium is discharged outside the apparatus.

The electrophotographic photoreceptor according to the present invention is described in more detail in the following description in reference to the examples including the experimental examples and comparative examples.

(Synthesis Example of Phthalocyanine: 1)

To a mixture of 64.4 g of phthalodinitrile and 150 ml of α-chloronaphthalene, 6.5 ml of titanium tetrachloride is added dropwise in nitrogen stream for 5 minutes. After the dropwise addition, the mixture is heated in a mantle heater to 200° C. for 2 hours in order to complete the reaction. The precipitate is filtered, and the filtered cake is rinsed with α-chloronaphthalene, and then rinsed with chloroform, and further rinsed with methanol. After that, the rinsed cake is treated by hydrolysis using a mixture of 60 ml of concentrated ammonia water and 60 ml of ion-exchanged water at boiling point for 10 hours. Then, the hydrolyzed mixture is subjected to suction-filtration at room temperature. The resulting cake is rinsed by pouring ion-exchanged water. The rinsing is continued until the filtrate ion-exchanged water became neutral.

Then, the cake is further rinsed with methanol, and is dried by hot air at 90° C. for 10 hours. The resulting product is 64.6 g of crystalline titanyl phthalocyanine powder in blue-purple color.

The resulting powder is dissolved in about ten folds of volume of concentrated sulfuric acid, and is then poured into water to generate precipitate; and the mixture is filtered. The wet cake is agitated in dichloroethane at room temperature for 1 hour, thereby obtaining 40 g of titanyl phthalocyanine of the present invention.

(Synthesis Example of Phthalocyanine: 2)

To a mixture of 64.4 g of phthalodinitrile and 150 ml of α-chloronaphthalene, 6.5 ml of titanium tetrachloride is added dropwise in nitrogen stream for 5 minutes. After the dropwise addition, the mixture is heated in a mantle heater to 200° C. for 2 hours to complete the reaction.

The precipitate is filtered, and the cake is rinsed with α-chloronaphthalene, and then rinsed with chloroform, and further rinsed with methanol. After that, the rinsed cake is treated by hydrolysis using a mixture of 60 ml of concentrated ammonia water and 60 ml of ion-exchanged water at boiling point for 10 hours, then the hydrolyzed mixture is subjected to suction-filtration at room temperature. The resulting cake is rinsed with ion-exchanged water similar to the Synthesis example 1. After that, the cake is rinsed with methanol, and is dried by hot air at 90° C. for 10 hours. The resulting product is 64.6 g of crystalline titanyl phthalocyanine powder in blue-purple color.

The resulting powder is dissolved in about ten folds of volume of concentrated sulfuric acid; and the mixture is then rinsed with water and is dried to obtain 40 g of titanyl phthalocyanine of the present invention.

EXAMPLE A1

An alkyd resin (sold under the name "Bekkolite M-6401-50", manufactured by Dainippon Ink and Chemicals, Incorporated) and an amino resin (sold under the name "Super Bekkamin G-821-60", manufactured by Dainippon Ink and Chemicals, Incorporated) were mixed at a ratio of 65:35. The mixture is further mixed with a titanium oxide (trade name "CR-EL", manufactured by Ishihara Sangyo Kaisha, Ltd.) at a ratio of 1:3. The mixture is dissolved in methyl ethyle ketone in order to prepare the coating solution. The coating solution is applied on a cylindrical drum made of non-cut aluminum having 24 mm of diameter, thereby forming an undercoating layer having a thickness of 1.5 μm.

Next, 10 g of oxytitanium phthalocyanine powder prepared by Synthesis example 1 is added to glass beads and a solution of which 10 g of polyvinyl butylal resin (sold under the name "BM-1", manufactured by Sekisui Chemical Co., Ltd.) is solved in 500 ml of 1,3-dioxolane. The mixture is dispersed by a sand mill disperser for 20 hours. The prepared dispersed liquid is filtered to remove glass beads in order to obtain the coating solution for the charge-generating layer. The coating solution is applied on the undercoating layer by immersion coating, and is dried to form the charge-generating layer having a thickness of 0.2 μm.

Then, a polycarbonate resin (sold under the name "Z400", manufactured by Mitsubishi Gas Chemical Company, Inc.) as a binder resin, the compound represented by the formula (A1a) as a charge-transfer agent, and N-phenyl-1-naphthylamine as an aromatic amine-based antioxidant are mixed at a weight ratio of 1.0:1.0:0.05. The mixture is dissolved in chloroform to prepare the coating solution for the charge-transfer layer.

The support member, on which charge-generating layer is formed, is immersed in the coating solution for the charge-transfer layer to coat thereon, then the support member is dried at 120° C. for 60 minutes to form the charge-transfer layer having a thickness of 25.0 μm, thereby preparing the electrophotographic photoreceptor.

Preparation of Sample for X-Ray Diffractometry

On the surface of the photoreceptor prepared in Example A1, cut line is made using an office cutter in the circumferential direction and in the cylindrical axis direction lateral to the circumferential direction, thereby forming cross cuts having about 2 cm for each side. The photosensitive film is peeled off at the cut portion using tweezers.

To a 50 ml beaker, 15 ml of 4-methoxy-4-methylpentanone is poured, and the peeled film is immersed therein to fully dissolve the charge-transfer layer. Thereafter, the mixture is agitated thoroughly to let gel-shaped fine pieces disperse in the solvent. The mixture is suction-filtered by a membrane filter made of Teflon (trade name) having pore size of 0.2 μm. The cake is rinsed with 10 ml of PTX (4-methoxy-4-methylpentanone). Then, the membrane filter is tightly attached to a silicon non-reflection in such a manner that the filtered material face inward, and only the membrane filter is peeled to bring the oxytitanium phthalocyanine adhere to the silicon non-reflection plate, and then, it is dried by air to obtain the sample for X-ray diffractometry.

X-ray Diffractometry

When analyzing the above-prepared sample, the powder method is applied using CuKα (wavelength of 1.54178 Å) as the X-ray source, with the following condition X-ray diffractometer: X' Pert, manufactured by Philips.

Analytical Conditions:
X-ray tube bulb: Cu
Scanning range: 4°to 29°
Tube voltage: 45 kV
Tube current: 40 mA
Step angle: 0.01 degree
Counting time: 20 seconds
Light-receiving slit, divergence slit: Variable type
Irradiation width: 20 mm FIG. 1 is a graph of the X-ray diffraction of the sample. According to FIG. 1, the oxytitanium phthalocyanine extracted from the photosensitive layer has diffraction peaks at Bragg angle (2θ±0.2°) of 9.7°, 14.2°, 18.0°, 24.2°, and 27.2°.

Generally, the substances called the "Y-type oxytitanium phthalocyanine" has a maximum peak at near 27.2° within ±0.2° in the range of error.

As the oxytitanium phthalocyanine of Example A1 has a maximum diffraction peak at 27.2°, it is the Y-type oxytitanium phthalocyanine.

EXAMPLE A2

Instead of the charge-generating agent obtained in Synthesis example 1, 10 g of oxytitanium phthalocyanine prepared in Synthesis example 2 is pulverized in the dry state together with glass beads; and then, the mixture is added to a solution of which 5 g of polyvinylbutylal resin is dissolved in 150 ml of methanol, and the mixture is dispersed by a sand mill for 30 minutes. Further, a liquid of 350 ml of methylethylketone containing 5 g of dissolved polyvinylbutylal is added to the dispersed mixture to disperse the mixture again in a sand mill for 20 hours. The dispersed liquid obtained is filtered to remove glass beads, and then the coating solution for the charge-generating layer is prepared. The coating solution obtained is immersion-coated, followed by drying to form the charge-generating layer having a thickness of 0.2 μm.

Figure 2:
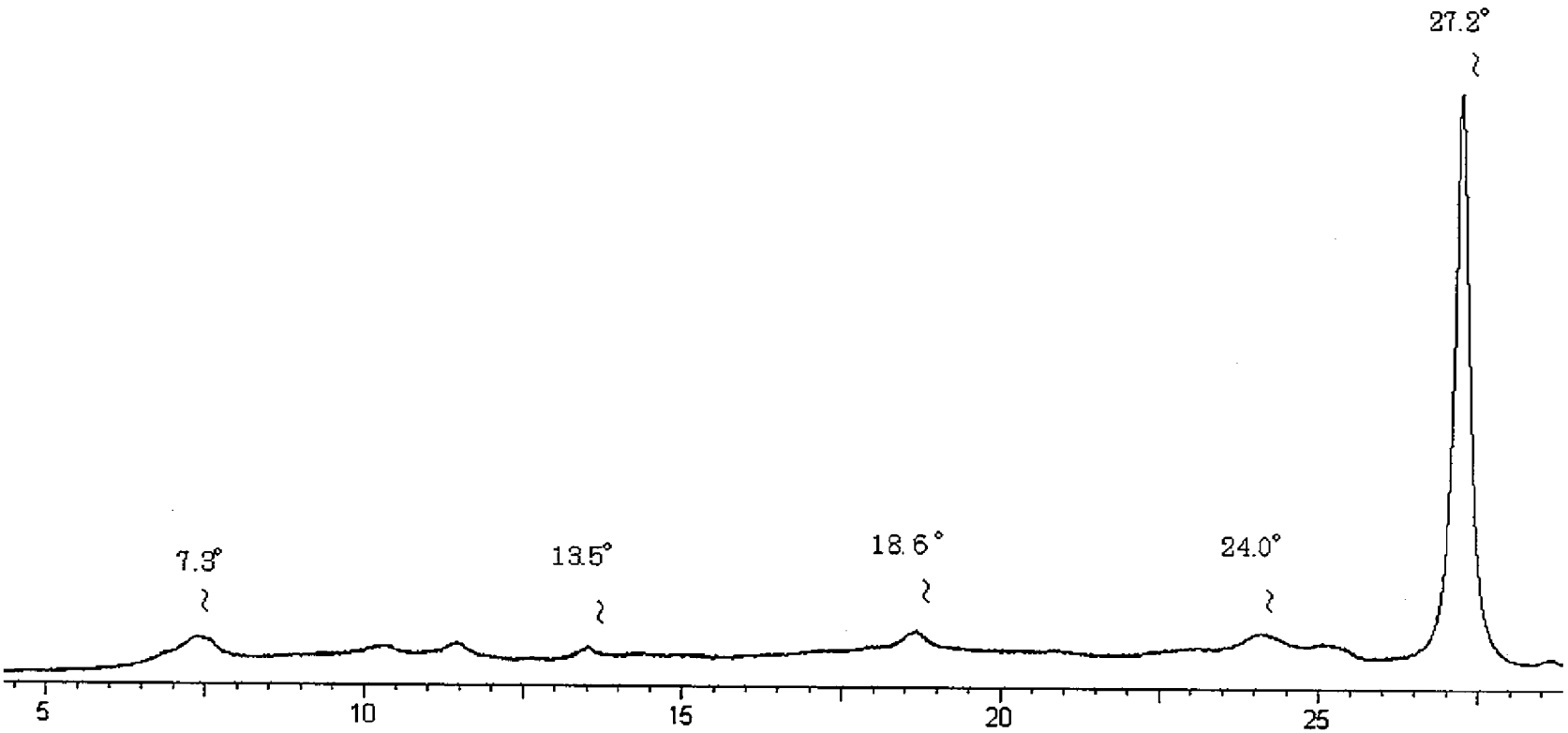
FIG. 2 is an X-ray diffraction chart of phthalocyanine composition according to the present invention.

By a similar procedure to that of Example A1, the electrophotographic photoreceptor is prepared. By X-ray diffractometry similar to that of Example A1, the X-ray diffraction chart of oxytitanium phthalocyanine extracted from the photosensitive layer is shown in FIG. 2.

The oxytitamium phthalocyanine has a typical diffraction peak (maximum diffraction peak) at 27.2°. The intensity of other diffraction peaks is 20% or less compared to that of a diffraction peak at 27.2°. In more detail, diffraction peaks are observed at the Bragg angle (2θ±0.2°) of 7.3°, 13.5°, 18.6°, 24.0°, and 27.2°.

EXAMPLE A3

An electrophotographic photoreceptor is prepared by a similar procedure to that of Example A2 except that the charge-transfer agent used in Example A2 is replaced with the charge-transfer agent represented by the formula (A1b); and further, the aromatic amine-based antioxidant is replaced with 2,6-di-ter-butyl-4-methylphenol as a phenol-based antioxidant.

EXAMPLE A4

An electrophotographic photoreceptor is prepared by a similar procedure to that of Example A2 except that the charge-transfer agent used in Example A2 is replaced with the charge-transfer agent represented by the formula (A1c); and further, the aromatic amine-based antioxidant is replaced with 2,6-di-ter-butyl-4-methylphenol as a phenol-based antioxidant.

EXAMPLE A5

An electrophotographic photoreceptor is prepared by a similar procedure to that of Example A1 except that the charge-transfer agent used in Example A1 is replaced with the charge-transfer agent represented by the formula (A1b).

EXAMPLE A6

An electrophotographic photoreceptor is prepared by a similar procedure to that of Example A1 except that the charge-transfer agent used in Example A1 is replaced with the charge-transfer agent represented by the formula (A1c).

EXAMPLE A7

An electrophotographic photoreceptor is prepared by a similar procedure to that of Example A1 except that the charge-transfer agent used in Example A1 is replaced with the charge-transfer agent represented by the Formula (A1d).

COMPARATIVE EXAMPLE A1

An electrophotographic photoreceptor is prepared by a similar procedure to that of Example A2 except that the charge-transfer agent used in Example A2 is replaced with the charge-transfer agent represented by the formula [AA].

Formula (AA)

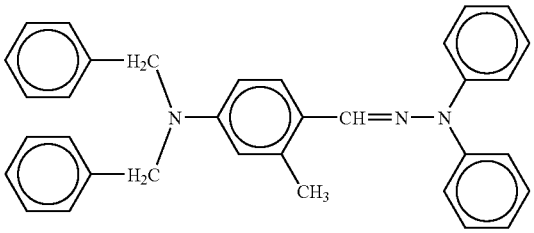

COMPARATIVE EXAMPLE A2

An electrophotographic photoreceptor is prepared by a similar procedure to that of Example A2 except that the charge-transfer agent used in Example A2 is replaced with the charge-transfer agent represented by the formula [AB].

Formula (AB)

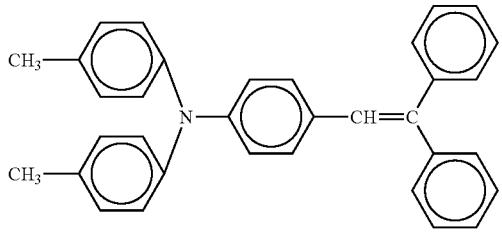

COMPARATIVE EXAMPLE A3

Figure 3:
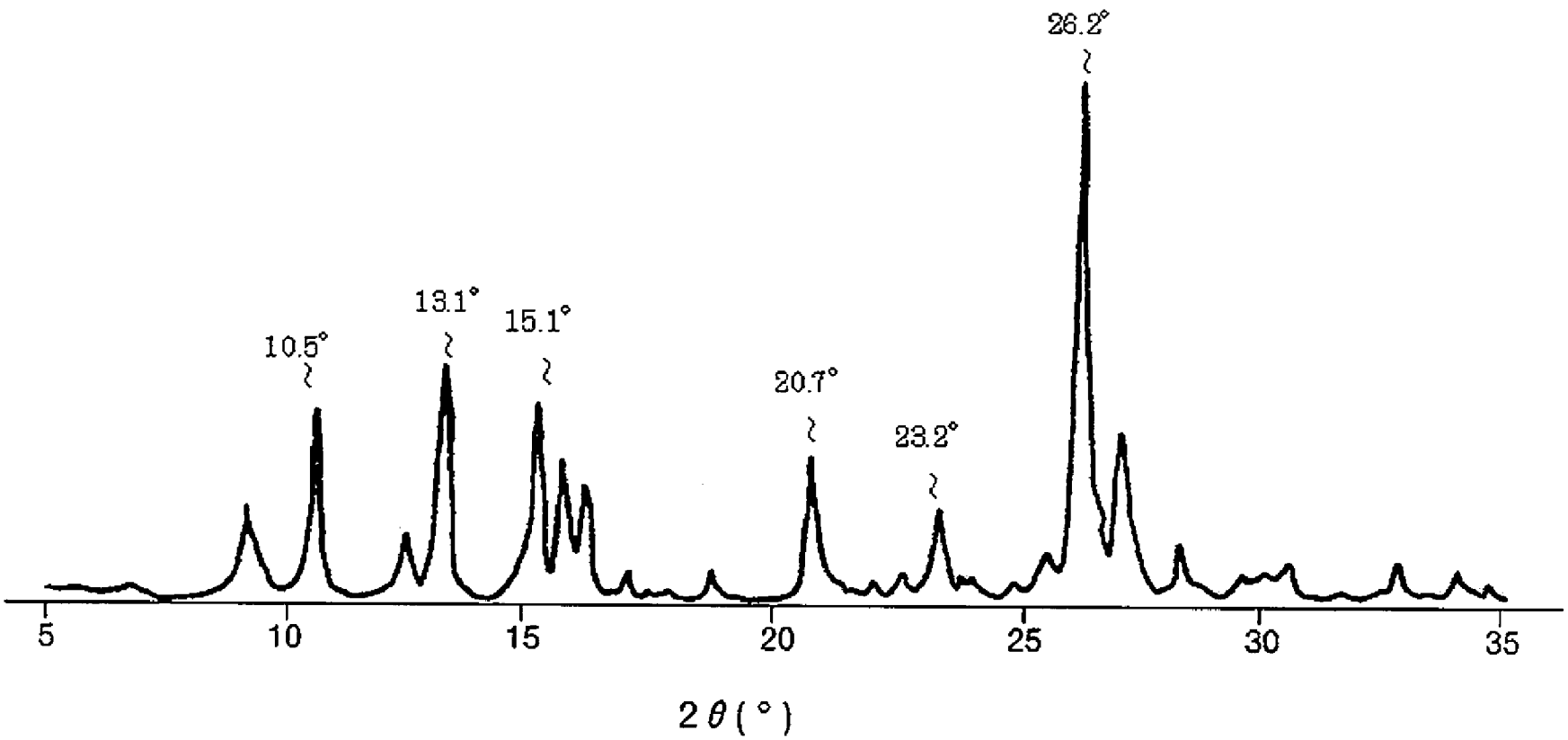
FIG. 3 is an X-ray diffraction chart of β-type oxytitanium phthalocyanine.

An electrophotographic photoreceptor is prepared by a similar procedure to that of Example A2 except that the charge-transfer agent used in Example A2 is replaced with the β-type oxytitanium phthalocyanine with the x-ray diffraction chart shown in FIG. 3.

COMPARATIVE EXAMPLE A4

An electrophotographic photoreceptor is prepared by a similar procedure to that of Example A1 except that the charge-transfer agent used in Example A1 is replaced with the charge-transfer agent represented by the formula [AA].

COMPARATIVE EXAMPLE A5

An electrophotographic photoreceptor is prepared by a similar procedure to that of Example A1 except that the charge-transfer agent used in Example A1 is replaced with the charge-transfer agent represented by the formula [AB].

<Evaluation Method>

The evaluation method is described below. The electrophotographic photoreceptor evaluation apparatus manufactured by Yamanashi Electronics Co., Ltd. is applied. The electrophotographic photoreceptors prepared in Experimental examples, Examples, and Comparative Examples, are evaluated by measuring the electrostatic characteristics of surface potential (V0), the residual potential (VL), exposure amount of 0.4 μJ/cm$^2$ after the first cycle as an initial value, and the electrostatic characteristics of the surface potential (V0), the residual potential (VL) and exposure amount of 0.4 μJ/cm$^2$ after the ten thousand cycles, setting the steps of charge, exposure, development, and transfer as one cycle, and calculating differential value. The result is shown in Table 1.

TABLE 1

Result of evaluation tests

| | Initial potential | | Potential after ten thousand cycle | | Exposure amount reduced by half (Sensitivity potential) |
|---|---|---|---|---|---|
| | V0(−V) | VL(−V) | V0(−V) | VL(−V) | E½(μ J/cm$^2$) |
| Example A1 | 700 | 32 | 700 | 33 | 0.08 |
| Example A2 | 705 | 30 | 700 | 32 | 0.12 |
| Example A3 | 695 | 30 | 650 | 33 | 0.11 |
| Example A4 | 695 | 35 | 645 | 38 | 0.12 |
| Example A5 | 700 | 60 | 705 | 55 | 0.09 |
| Example A6 | 705 | 30 | 700 | 32 | 0.08 |
| Example A7 | 705 | 35 | 705 | 38 | 0. 08 |
| Comparative example A1 | 705 | 70 | 690 | 165 | 0.20 |
| Comparative example A2 | 710 | 38 | 705 | 85 | 0.14 |
| Comparative example A3 | 700 | 64 | 640 | 142 | 0.50 |
| Comparative example A4 | 700 | 60 | 685 | 154 | 0.11 |
| Comparative example A5 | 710 | 45 | 715 | 92 | 0.09 |

As is clear from Table 1, by the combination of the charge-generating agent and the charge-transfer agent according to the invention of the present application, Examples A1 to A7 did not exhibit major changes in the charge potential and residual potential between the initial stage and after ten thousand cycles, giving good photoreceptor characteristics. For Examples A1 and A2 combined with aromatic amine-based antioxidant showed strong resistance to light fatigue and the decrease in the surface potential (V0) after ten thousand cycles is within 5 V, which is at a good level.

Furthermore, Examples A3 and A4 combined with phenol-based antioxidant can be used commercially with no problems, since the residual potential (VL) did not exhibit major changes, though the surface potential (V0) decreased to some extent.

To the contrary, in Comparative Examples A1 to A5, with a combination of the charge-generating agent of the present invention and other charge-transfer agents, the residual potential after ten thousand cycles significantly changed, which is unsatisfactory for the photoreceptor characteristics.

According to the combination of other additional charge-generating agents and the charge-transfer agent of the present invention, the residual potential after ten thousand cycles significantly changed, which is unsatisfactory for the photoreceptor characteristics.

As is clear from the comparison between Examples A1, A5 to A7 and Examples A2 to A4, the use of oxytitanium phthalocyanine represented by FIG. 1 gives smaller half-value exposure amount and higher sensitivity than that of oxytitanium phthalocyanine represented by FIG. 2, even if the same charge-transfer agent is applied in both cases.

The invention of the present application can provide a good photoreceptor, which has excellent resistance to dielectric breakdown to the contact charging and generates no increase in the residual potential through the use of an eraseless electrophotographic apparatus.

EXAMPLES

The examples of electrophotographic photoreceptor formed using tetrahydrofuran are described below in detail. The present invention, however, is not limited to the combinations given in the following examples.

EXAMPLE C1

An alkyd resin (sold under the name "Bekkolite M-6401-50", manufactured by Dainippon Ink and Chemicals, Incorporated) and an amino resin (sold under the name "Super Bekkamin G-821-601", manufactured by Dainippon Ink and Chemicals, Incorporated) are mixed at a ratio of 65:35 (by weight). The mixture resin and a titanium oxide (sold under the name "CR-EL" manufactured by Ishihara Sangyo Kaisha, Ltd.) at a ratio of 1:3 (by weight) are dissolved in methylethleketone for preparing the coating solution. Onto a cylindrical drum made of an aluminum alloy having 30 mm of diameter, as the conductive support member 21, the coating solution is applied and dried to form an undercoating layer having a thickness of 1.5 μm.

Then, a dispersion liquid of Y-type oxytitanium phthalocyanine (manufactured by Mitsubishi Paper Mills Limited) using a polyvinyl butylal resin (sold under the name "BM-1", manufactured by Sekisui Chemical Co., Ltd.) as the binder resin is applied on the undercoating layer by the immersion coating process, and then dried to laminate the charge-generating layer 22 having a thickness of 0.1 μm on the undercoating layer. The Y-type oxytitanium phthalocyanine used in Example C1 has the same X-ray diffraction chart as that represented by FIG. 1.

Next, the charge-transfer agent represented by the formula (C1a), the antioxidant (N-phenyl-1-naphtylamine) as an additive, and the polycarbonate resin (sold under the name "Z400", manufactured by Mitsubishi Gas Chemical Company, Inc.) as a binder resin are dissolved in tetrahydrofuran, thereby obtaining the coating material for the charge-transfer layer.

The coating material is immersion-coated onto the charge-generating layer 22, which is then dried by heating to form the charge-transfer layer 23 having a thickness of 18 μm, thereby obtaining the electrophotographic photoreceptor 11 of Example C1.

EXAMPLE C2

The electrophotographic photoreceptor 11 of Example C2 is prepared under the same conditions as those of Example C1 except that the compound of the formula (C1a) as the charge-transfer substance is replaced with the compound of the formula (C1b).

EXAMPLE C3

The electrophotographic photoreceptor 11 of Example C3 is prepared under the same conditions as those of Example C1 except that the compound of the formula (C1a) as the charge-transfer substance is replaced with the compound of the formula (C1c).

EXAMPLE C4

The electrophotographic photoreceptor 11 of Example C4 is prepared under the same conditions as those of Example C1 except that the compound of the formula (C1a) as the charge-transfer substance is replaced with the compound of the formula (C1d).

EXAMPLE C5

The electrophotographic photoreceptor 11 of Example C5 is prepared under the same conditions as those of Example C1 except that the coating material for the charge-transfer layer is prepared by using a phenol-based antioxidant as an antioxidant used for the charge-transfer layer.

The charge-transfer layer is separated from each of the electrophotographic photoreceptors of Examples C1 to C6, and the qualitative test for the residual THF (tetrahydrofuran) in the charge-transfer layer is performed to the separated charge-transfer layer using a thermal decomposition gas chromatography (GCMS-QP2000GF, manufactured by Shimadzu Corporation). It is confirmed that THF remains in each charge-transfer layer.

EXAMPLE C1d

The electrophotographic photoreceptor of Example C1d is prepared under the same conditions as those of Example C1 except that the coating material for the charge-transfer layer is prepared by using methylene chloride instead of tetrahydrofuran as a coating-preparation solvent used in the coating for the charge-transfer layer.

EXAMPLE C2d

The electrophotographic photoreceptor of Example C2d is prepared under the same conditions as those of Example C1 except that the coating material for the charge-transfer layer is prepared by using chloroform instead of tetrahydrofuran as a coating-preparation solvent.

COMPARATIVE EXAMPLE C3

The electrophotographic photoreceptor of Comparative Example C3 is prepared under the same conditions as those of Example C1 except that the compound of the formula (C1a) as a charge-transfer substance is replaced with the compound of the formula (CA).

Chemical formula (CA)

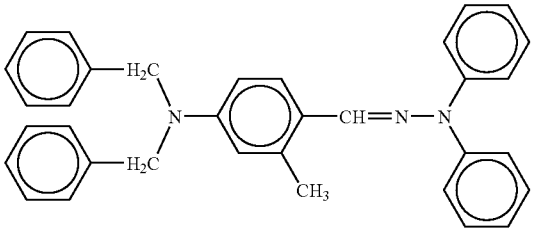

COMPARATIVE EXAMPLE C4

The electrophotographic photoreceptor of Comparative Example C4 is prepared under the same conditions as those of Example C1 except that the compound of the formula (C1a) as a charge-transfer substance is replaced with the compound of the formula (CB).

Chemical formula (CB)

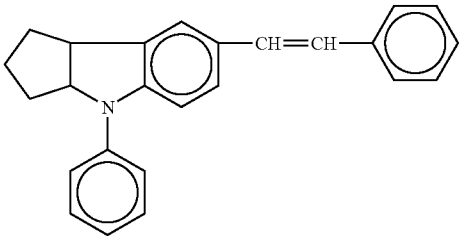

COMPARATIVE EXAMPLE C5

Figure 6:
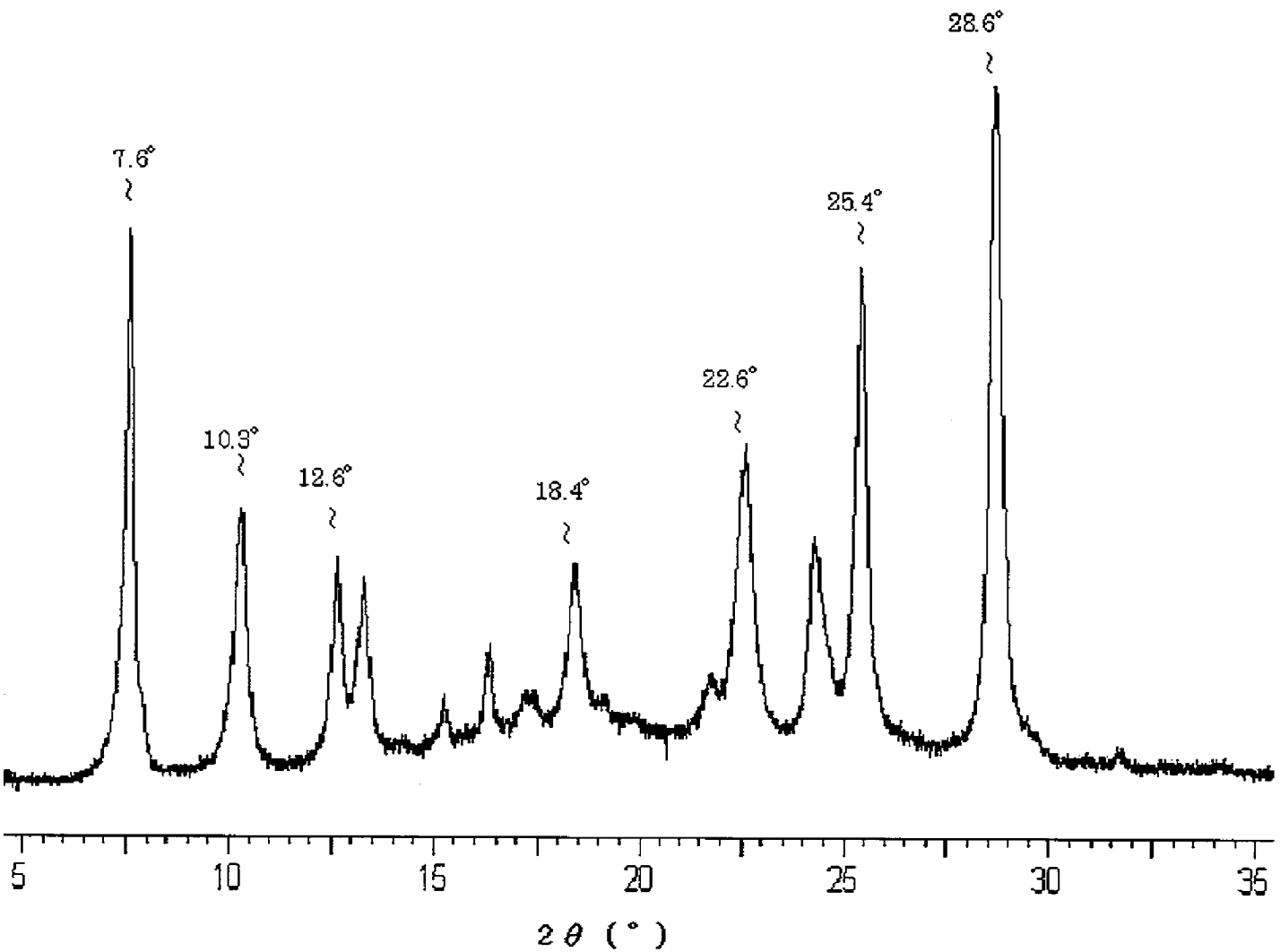
FIG. 6 is an X-ray diffraction chart of α-type oxytitanium phthalocyanine.

The charge-generating layer and the charge-transfer layer are formed on the conductive support member by a similar procedure to that of Example C1 except that the oxytitanium phthalocyanine used for the charge-generating layer in Example C1 is replaced with α-type oxytitanium phthalocyanine. The α-type oxytitanium phthalocyanine used in Comparative Example C5 has the same X-ray diffraction chart as that represented in FIG. 6.

<Evaluation Tests>

The evaluation methods are described below.

[Determination of Electrostatic Characteristics]

Each of the electrophotographic photoreceptors 11 of above-mentioned Examples C1 to C5, Examples C1d and C2d, and Comparative Examples C3 to C5 is mounted on an electrophotographic photoreceptor evaluation apparatus (manufactured by Yamanashi Electronics Co., Ltd.) to provide the electrophotographic apparatus 1 shown in FIG. 5.

The electrophotographic apparatus 1 is evaluated on the electrostatic characteristics by measuring the surface potential (V0) and the residual potential (VL) of a first cycle as an initial value and the surface potential (V0) and the residual potential (VL) after the ten thousand cycles, setting the steps of charge, exposure, development, and transfer as one cycle, and calculating the differential value.

The transition time (the circumferential speed) from the image exposure step to the development step is set as given in Table 2. The result is shown in Table 2.

TABLE 2

| | Result of evaluation tests | | | | |
|---|---|---|---|---|---|
| | Circumferential | Initial potential | | Potential after ten thousand cycle | |
| | speed (sec.) | V0(−V) | VL(−V) | V0(−V) | VL(V) |
| Example C1 | 0.05 | 700 | 30 | 695 | 32 |
| Example C2 | 0.10 | 705 | 30 | 700 | 33 |
| Example C3 | 0.08 | 700 | 30 | 695 | 31 |
| Example C4 | 0.03 | 695 | 35 | 690 | 38 |
| Example C5 | 0.08 | 695 | 35 | 681 | 38 |
| Example C6 | 0.15 | 710 | 45 | 705 | 48 |
| Example C1d | 0.08 | 705 | 30 | 650 | 32 |
| Example C2d | 0.08 | 695 | 32 | 638 | 38 |
| Comparative example C3 | 0.08 | 700 | 64 | 695 | 142 |
| Comparative example C4 | 0.08 | 705 | 58 | 705 | 128 |
| Comparative example C5 | 0.08 | 700 | 160 | 705 | 210 |

Example C6 in Table 2 shows the evaluation result in the electrophotographic apparatus 1 using the electrophotographic photoreceptor of Example C1, while setting the transition time from the image exposure step to the development step to 0.15 second.

As is clear from the above Table 2, through the combination of compound of general formula (C1) and tetrahydrofuran in Examples C1 to C5, the initial charge potential and initial residual potential, and charge potential and residual potential after ten thousand cycles also do not significantly change thereby, providing good photoreceptor characteristics.

Also in Example C6, the photoreceptor characteristics are excellent. Thus, the electrophotographic photoreceptor according to the invention of the present application is applicable not only to a high circumferential speed of 0.1 second or less but also to a low circumferential speed exceeding 0.1 second.

To the contrary, as a result of Examples C1d and C2d in which a solvent other than tetrahydrofuran is used, the charge potential after ten thousand cycles is significantly changed, and it is thus unsatisfactory for the photoreceptor characteristics.

As a result of Comparative Examples C3 and C4 in which a compound other than the compound of the general formula (C1) as a charge-transfer agent is used, the initial residual potential and the residual potential after ten thousand cycles changed significantly, and it is thus unsatisfactory for the photoreceptor characteristics.

As described above, when the step of forming the photosensitive layer 25 adopts a solvent other than tetrahydrofuran, or adopts a compound other than the compound of the general formula (C1) as a charge-transfer agent, the photoreceptor characteristics are unsatisfactory particularly in an apparatus that produces high circumferential speed of 0.1 second or less.

As a result of Comparative Example C5 in which the charge-generating agent is changed to α-type compound, the initial residual potential and the residual potential after ten thousand cycles changed significantly, and it is thus unsatisfactory for the photoreceptor characteristics. Consequently, even if tetrahydrofuran is used as a solvent, the use of α-type oxytitanium phthalocyanine gives unsatisfactory results of photoreceptor characteristics for an apparatus having high circumferential speed of 0.1 second or less.

What is claimed is:

1. An electrophotographic apparatus having an electrophotographic photoreceptor, a contact charging device to charge the electrophotographic receptor, which is directly in contact with the electrophotographic photoreceptor and without a neutralizing apparatus, an exposure device which exposes the charged electrophotographic photoreceptor to light so as to form a latent image on the surface of the electrophotographic photoreceptor, and a development device which causes toner to adhere to the latent image on the surface of the electrophotographic photoreceptor, the electrophotographic apparatus transfers the toner adhered on the electrophotographic photoreceptor to a printing medium, the electrophotographic photoreceptor, comprising:

a conductive support member; and a photosensitive layer placed on the conductive support member, wherein the photosensitive layer includes a charge-generating agent and a charge-transfer agent, wherein the charge-generating agent is oxytitanium phthalocyanine having a Bragg angle (2θ) giving a maximum peak at 27.2°±0.2° in the X-ray diffraction spectra using CuKα as a radiation source, and wherein the charge-transfer agent includes at least one compound selected from the group consisting of compounds represented by the following formulae (A1a) to (A1d), Formula (A1a)

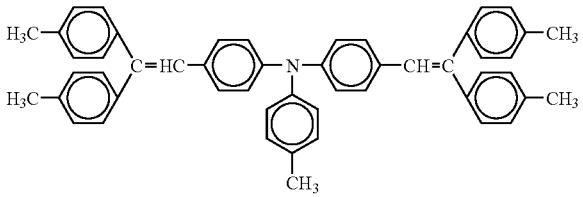

Formula (A1b)

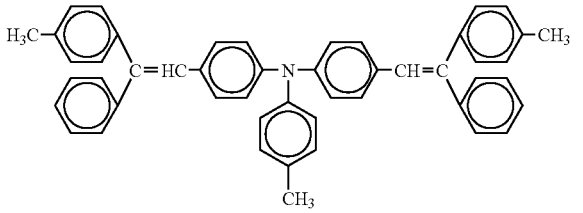

-continued

Formula (A1c)

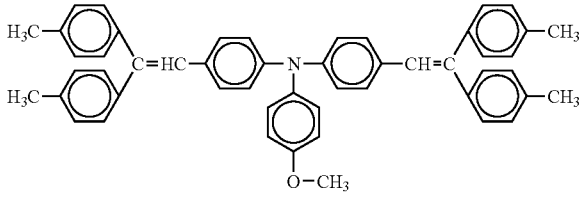

Formula (A1d)

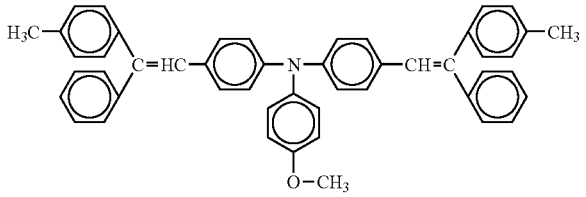

wherein the photosensitive layer is formed by dissolving the charge-transfer agent in tetrahydrofuran, followed by evaporating the tetrahydrofuran, and wherein the photosensitive layer includes the tetrahydrofuran, wherein the electrophotographic photoreceptor has an undercoating layer formed between the support member and the photosensitive layer, and the undercoating layer includes alkyd resin, amino resin and titanium oxide.

2. The electrophotographic apparatus according to claim 1, wherein the oxytitanium phthalocyanine has diffraction peaks at 9.7°, 14.2°, 18.0°, 24.2°, and 27.2° of Bragg angle (2θ±0.2°).

3. The electrophotographic apparatus according to claim 1, wherein the photosensitive layer includes an aromatic amine-based antioxidant.

4. The electrophotographic apparatus according to claim 1, wherein the circumferential speed of the electrophotographic photoreceptor from the exposure position where the electrophotographic photoreceptor is exposed to light, to the development position that causes the toner to adhere to the latent image is at most 0.1 second.

* * * * *